US007011057B2

(12) United States Patent
Machida et al.

(10) Patent No.: US 7,011,057 B2
(45) Date of Patent: Mar. 14, 2006

(54) VARIABLE VALVE OPERATING CONTROL APPARATUS FOR INTERNAL COMBUSTION ENGINE AND CONTROL METHOD THEREOF

(75) Inventors: Kenichi Machida, Isesaki (JP); Masahiko Watanabe, Atsugi (JP); Yoshiyuki Kobayashi, Atsugi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 11/064,100

(22) Filed: Feb. 24, 2005

(65) Prior Publication Data

US 2005/0188934 A1 Sep. 1, 2005

(30) Foreign Application Priority Data

Feb. 26, 2004 (JP) ..... 2004-051628
Jan. 5, 2005 (JP) ..... 2005-000337

(51) Int. Cl.
*F01L 1/34* (2006.01)

(52) U.S. Cl. ..... 123/90.16; 123/90.15; 123/90.17; 123/90.2; 123/90.31

(58) Field of Classification Search ..... 123/90.16, 123/90.15
See application file for complete search history.

(56) References Cited

U.S. PATENT DOCUMENTS 6,776,130 B1 * 8/2004 Miyakoshi et al. ..... 123/90.15
6,920,852 B1 * 7/2005 Machida ..... 123/90.16

FOREIGN PATENT DOCUMENTS

JP 2000-297686 A 10/2000

OTHER PUBLICATIONS

U.S. Appl. No. 11/065,521, filed Feb. 25, 2005, Machida et al.

* cited by examiner

*Primary Examiner*—Thomas Denion
*Assistant Examiner*—Kyle M. Riddle
(74) *Attorney, Agent, or Firm*—Foley & Lardner LLP

(57) ABSTRACT

A centric phase of an operating angle of an engine valve is detected on the basis of an interval between a reference rotational position of a crankshaft and a reference rotational position of a camshaft, and on the other hand, the centric phase is detected each predetermined time, and a Variable valve Timing Control mechanism is feedback-controlled on the basis of a value which has been updated more recently between both detected results.

20 Claims, 28 Drawing Sheets

VARIABLE VALVE OPERATING CONTROL APPARATUS FOR INTERNAL COMBUSTION ENGINE AND CONTROL METHOD THEREOF

BACKGROUND OF THE INVENTION

1. Field of the Invention

The present invention relates to a variable valve operating control apparatus for an internal combustion engine having a variable valve timing mechanism and a control method thereof.

2. Description of the Related Art

In Japanese Unexamined Patent Publication 2000-297686, there is disclosed a variable valve timing mechanism which varies a timing of opening and closing an engine valve due to a rotational phase of a camshaft with respect to a crankshaft of an internal combustion engine being varied.

In a control apparatus for the variable valve timing mechanism, a rotational phase is detected on the basis of a interval between a detection signal at a reference rotational position of a crankshaft and a detection signal at a reference rotational position of a camshaft, and the variable valve timing mechanism is feedback-controlled on the basis of the detected result.

When a rotational phase is detected on the basis of the reference rotational positions, a detected value as a rotational phase is updated each constant crank angle.

Therefore, if a period for the updating is made long due to an engine being operated at low rotational speed, a large deviation is generated between a detected value and an actual value during the interval of updating.

Then, there are cases in which an overshoot is brought about due to feedback control being carried out on the basis of a detected value as a rotational phase different from an actual value during the interval of updating.

SUMMARY OF THE INVENTION

Then, an object of the present invention is to avoid bringing about an overshoot due to a delay in updating a rotational phase detected on the basis of reference rotational positions.

In order to achieve the above-described object, in the present invention, a centric phase of an operating angle of an engine valve is detected each predetermined crank angle, and further, a centric phase of an operating angle of the engine valve is detected each predetermined time, and in a timing of updating each predetermined crank angle, a Variable valve Timing Control mechanism is feedback-controlled on the basis of the centric phase detected each predetermined crank angle, and during the interval of updating at each predetermined crank angle, the Variable valve Timing Control mechanism is feedback-controlled on the basis of the centric phase detected each predetermined time.

The other objects and features of this invention will become understood from the following description with reference to the accompanying drawing.

PREFERRED EMBODIMENT

Figure 1:
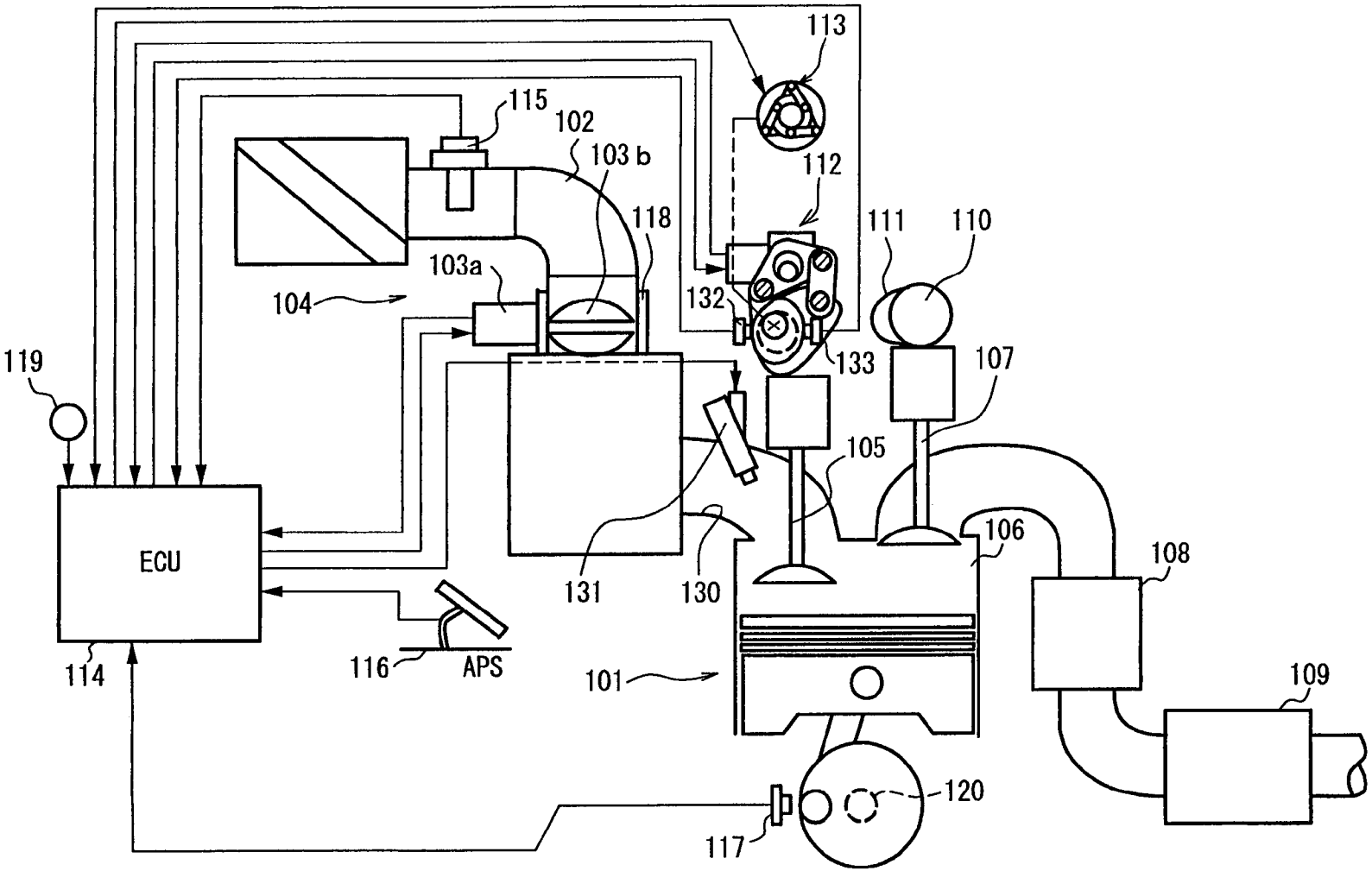
FIG. 1 is a system diagram of an internal combustion engine in an embodiment of the present invention.

FIG. 1 is a system block diagram of an engine on vehicle in an embodiment of the present invention.

An electronic control throttle 104 is set at an intake pipe 102 of an internal combustion engine 101 in FIG. 1.

Electronic control throttle 104 is a device controlling to open and close a throttle valve 103*b* by a throttle motor 103*a*.

Then, air is sucked into a combustion chamber 106 of engine 101 via electronic control throttle 104 and an intake valve 105.

Exhaust gas of engine 101 is exhausted from combustion chamber 106 via an exhaust valve 107, and thereafter, the exhaust gas is purged through a front catalytic converter 108 and a rear catalytic converter 109, and is discharged in the atmosphere.

Exhaust valve 107 is controlled to open and close so as to maintain given lift, operating angle, and valve timing by a cam 111 supported pivotally by an exhaust side camshaft 110.

On the other hand, a Variable valve Event and Lift (VEL) mechanism 112 which sequentially varies a lift of intake valve 105 along with an operating angle is provided at intake valve 105 side.

Moreover, a Variable valve Timing Control (VTC) mechanism 113 which sequentially varies the centric phase of the operating angle of intake valve 105 by varying a rotational phase of a camshaft which is at the air-intake side with respect to a crankshaft 120 is provided at intake valve 105 side.

An engine control unit (ECU) 114 in which a microcomputer is built-in controls VEL mechanism 112 and VTC mechanism 113 so as to obtain a required intake air quantity, a required cylinder residual gas ratio, and the like which correspond to a required torque, and on the other hand, controls electronic control throttle 104 so as to obtain a required suction pressure.

Detection signals from an air flow meter 115 detecting an intake air quantity of internal combustion engine 101, an accelerator pedal sensor 116 detecting an opening of an accelerator, a crank angle sensor 117 taking a unit angle signal POS each unit crank angle out of crankshaft 120, a throttle sensor 118 detecting an opening TVO of a throttle valve 103*b*, a water temperature sensor 119 detecting a temperature of cooling water in internal combustion engine 101, and a cam sensor 132 taking a cam signal CAM out of the camshaft are inputted to ECU 114.

Figure 11:
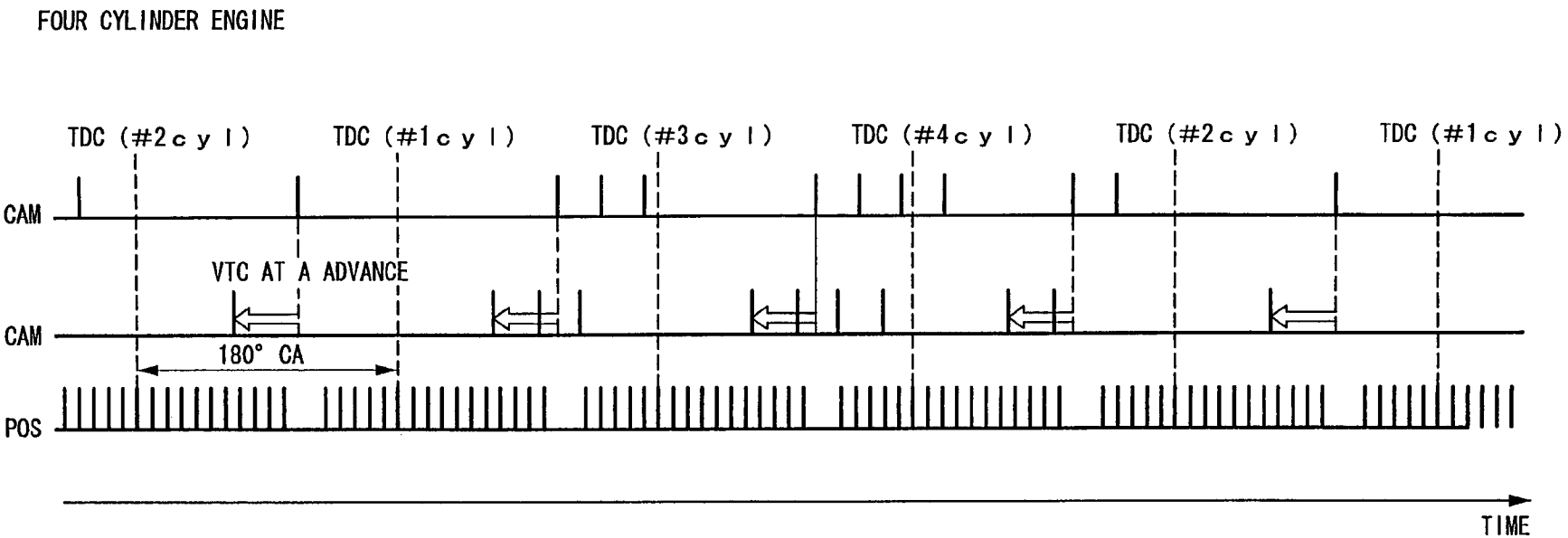
FIG. 11 is a timing chart showing output signals of a crank angle sensor and a cam sensor in the embodiment.

Here, crank angle sensor 117 detects a portion to be detected which is provided each crank angle of 10° with respect to a rotator rotating so as to be integrated with crankshaft 120, and in accordance therewith, as shown in FIG. 11, crank angle sensor 117 outputs a unit angle signal POS each crank angle of 10°. However, crank angle sensor 117 is structured that, because two points of the portions to be detected are sequentially omitted at two points with an interval at a crank angle of 180°, the unit angle signals POS is not outputted sequentially twice.

Note that the crank angle of 180° corresponds to a phase difference of the strokes between the cylinders in a four-cylinder engine in the present embodiment.

Then, the portion at which the unit angle signal POS is interrupted for a short time is detected on the basis of an output period and the like of the unit angle signal POS, and for example, a reference rotational position of crankshaft 120 is detected on the basis of a unit angle signal POS which is outputted for the first time after the unit angle signal POS is interrupted.

ECU 114 calculates an engine rotational speed by counting a period between detecting the reference rotational positions or the number of generations of the unit angle signals POS per a predetermined time.

Note that it may be a structure in which such that crank angle sensor 117 separately outputs a reference angle signal REF at every reference rotational position (each angle of 180°) of crankshaft 120 and a unit angle signal POS without any omission.

Further, cam sensor 132 outputs a cam signal CAM denoting a cylinder number (the first cylinder through the fourth cylinder) by a pulse number each cam angle of 90° corresponding to a crank angle of 180° as shown in FIG. 11, by detecting a portion to be detected which is provided at the rotator rotating so as to be integrated with the camshaft.

An electromagnetic fuel injection valve 131 is provided at an intake port 130 at an upstream side of intake valve 105 in each cylinder.

Fuel injection valve 131 is controlled to open the valve by an injection pulse signal from ECU 114, and injects out fuel of a quantity which is in proportion to an injection pulse width of the injection pulse signal.

Figure 2:
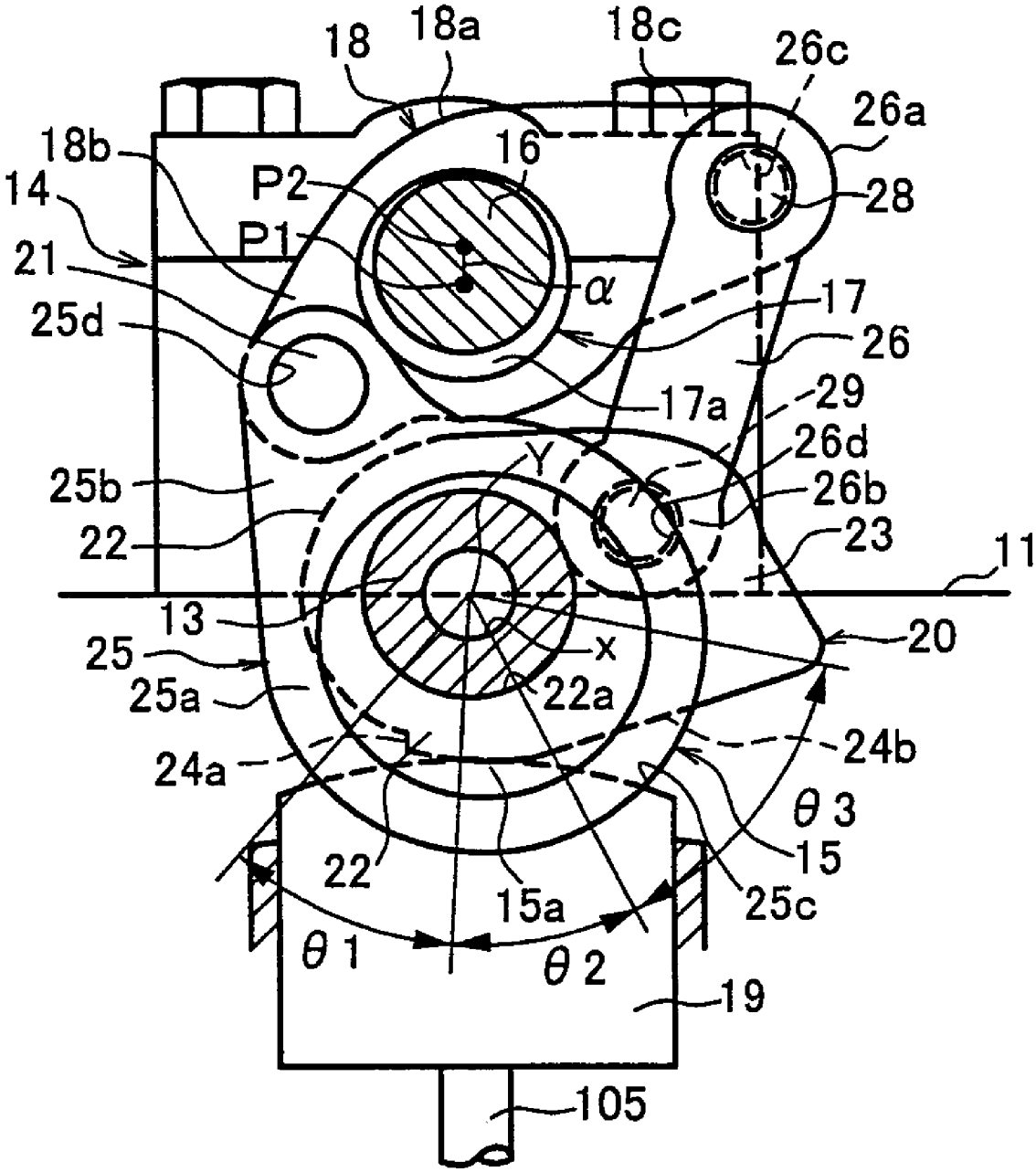
FIG. 2 is a sectional view (taken along A—A in FIG. 3) showing a Variable valve Event and Lift mechanism in the embodiment.
Figure 3:
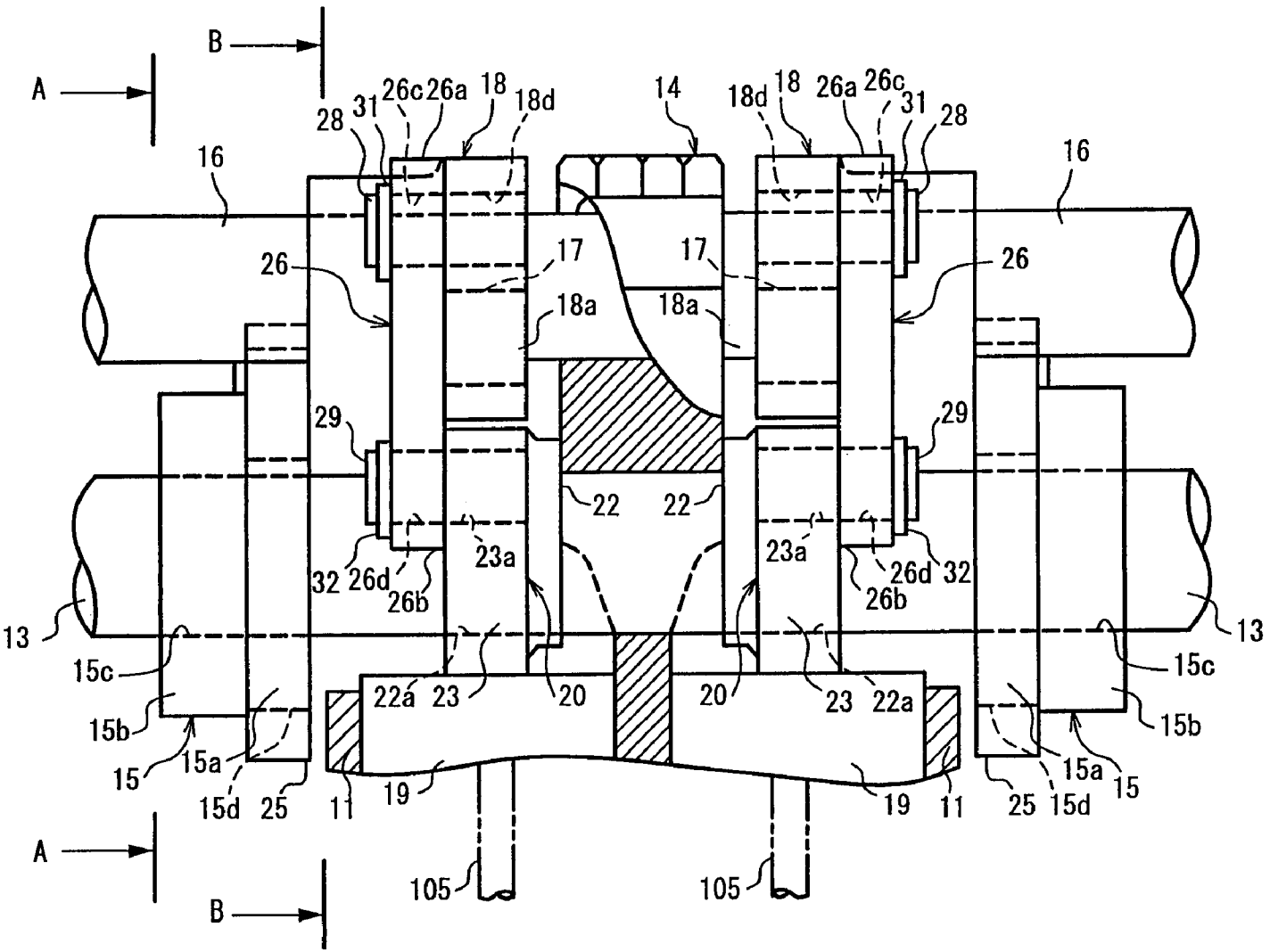
FIG. 3 is a side elevation of the Variable valve Event and Lift mechanism.
Figure 4:
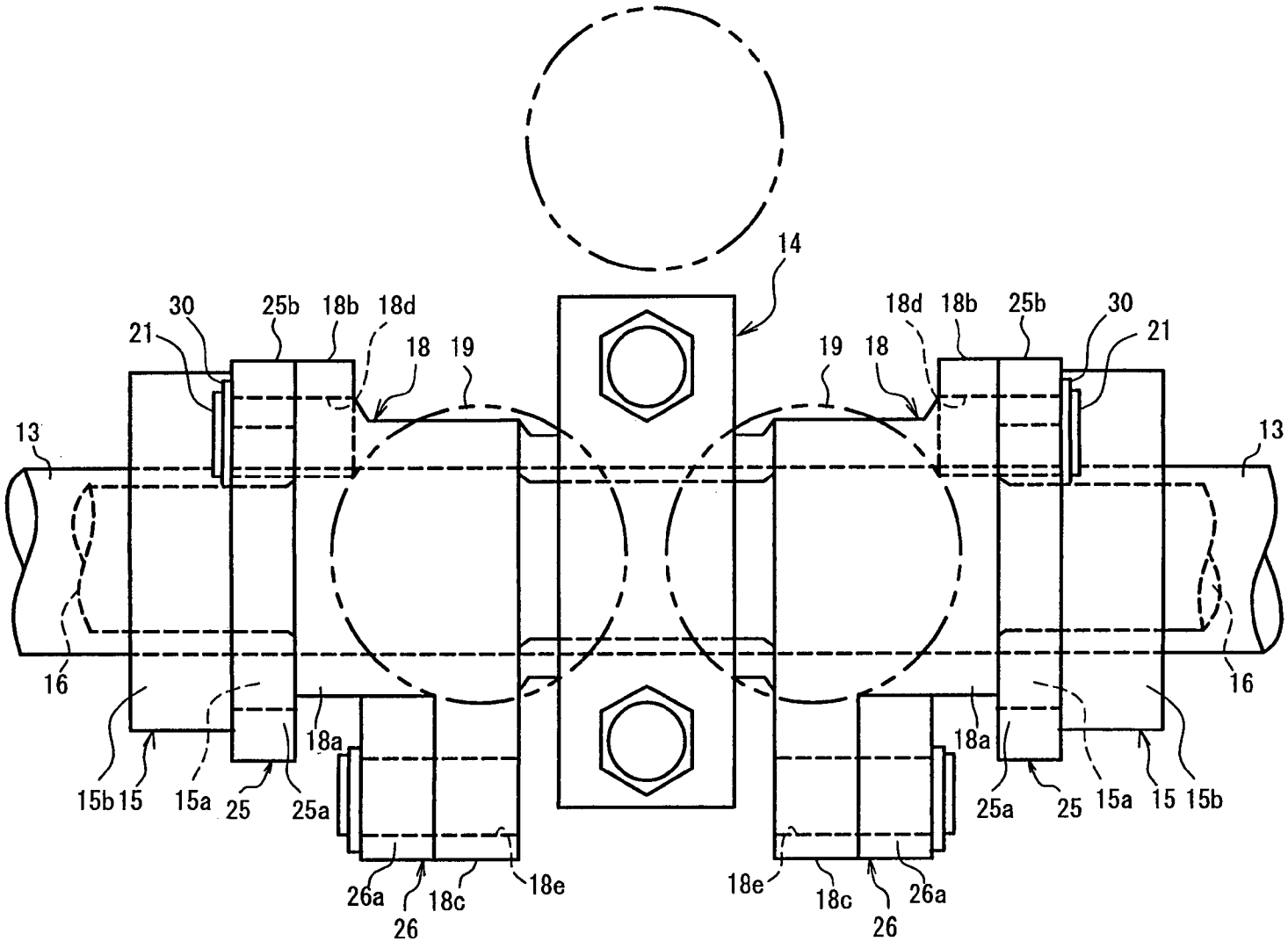
FIG. 4 is a plan view of the Variable valve Event and Lift mechanism.

FIG. 2 to FIG. 4 show the structure of VEL mechanism 112 in detail.

VEL mechanism 112 shown in FIG. 2 to FIG. 4 has a pair of intake valves 105 and 105, a hollow shaped camshaft 13 (driving shaft) supported to be freely pivotable by a cam bearing 14 of a cylinder head 11, two eccentric cams 15 and 15 (driving cams) which are the rotating cams supported pivotally by camshaft 13, a control shaft 16 supported to be freely pivotable by same cam bearing 14 at a position above camshaft 13, a pair of rocker arms 18 and 18 supported to be freely rockable via a control cam 17 by control shaft 16, and a pair of respectively separated rocker cams 20 and 20 which are disposed via valve lifters 19 and 19 at the top end portions of respective intake valves 105 and 105.

Eccentric cams 15 and 15, and rocker arms 18 and 18 are linked with one another by link arms 25 and 25, and rocker arms 18 and 18, and rocker cams 20 and 20 are linked with one another by link members 26 and 26.

Above-described rocker arms 18 and 18, link arms 25 and 25, and link members 26 and 26 structure a transmission mechanism.

Figure 5:
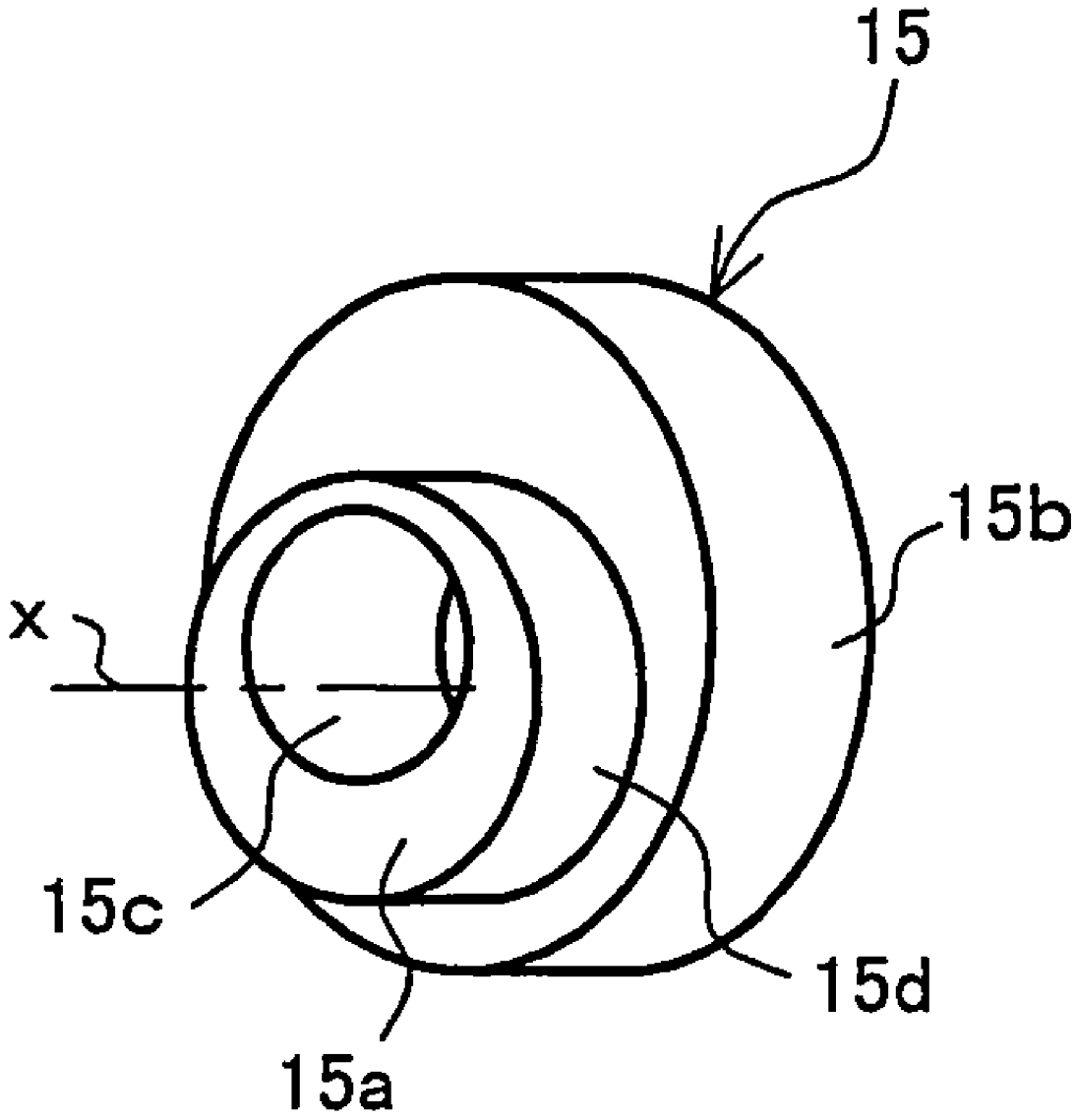
FIG. 5 is a perspective view showing an eccentric cam used for the Variable valve Event and Lift mechanism.

As shown in FIG. 5, eccentric cam 15 is formed in a substantially ring shape, and is formed from a small-diameter cam main body 15*a* and a flange portion 15*b* provided so as to be integrated with the outer end surface of cam main body 15*a*, and a camshaft through hole 15*c* is formed so as to pass through in the inner axis direction, and the axis X of cam main body 15*a* is eccentric by a predetermined amount from the axis Y of camshaft 13.

Further, eccentric cams 15 are fixed to be press-fitted at the both outer sides which do not interfere with valve lifters 19 with respect to camshaft 13 via camshaft through hole 15*c*.

Rocker arm 18 is, as shown in FIG. 4, formed to be wound in a substantially crank shape, and a base portion 18*a* at the center thereof is supported to be freely pivotable by control cam 17.

A pin hole 18*d* into which a pin 21 connected to a top end portion of link arm 25 is press-fitted is formed so as to pass through one end portion 18*b* provided so as to protrude at the outer end portion of base portion 18*a*, and on the other hand, a pin hole 18*e* into which a pin 28 linking together with one end portion 26*a*, which will be described later, of each link member 26 is press-fitted is formed at an other end portion 18*c* provided so as to protrude at the inner end portion of base portion 18*a*.

Control cam 17 is formed in a cylinder shape, and is fixed to the outer periphery of control shaft 16, and as shown in FIG. 2, the position of an axis position P1 is eccentric by α from an axis P2 of control shaft 16.

Figure 6:
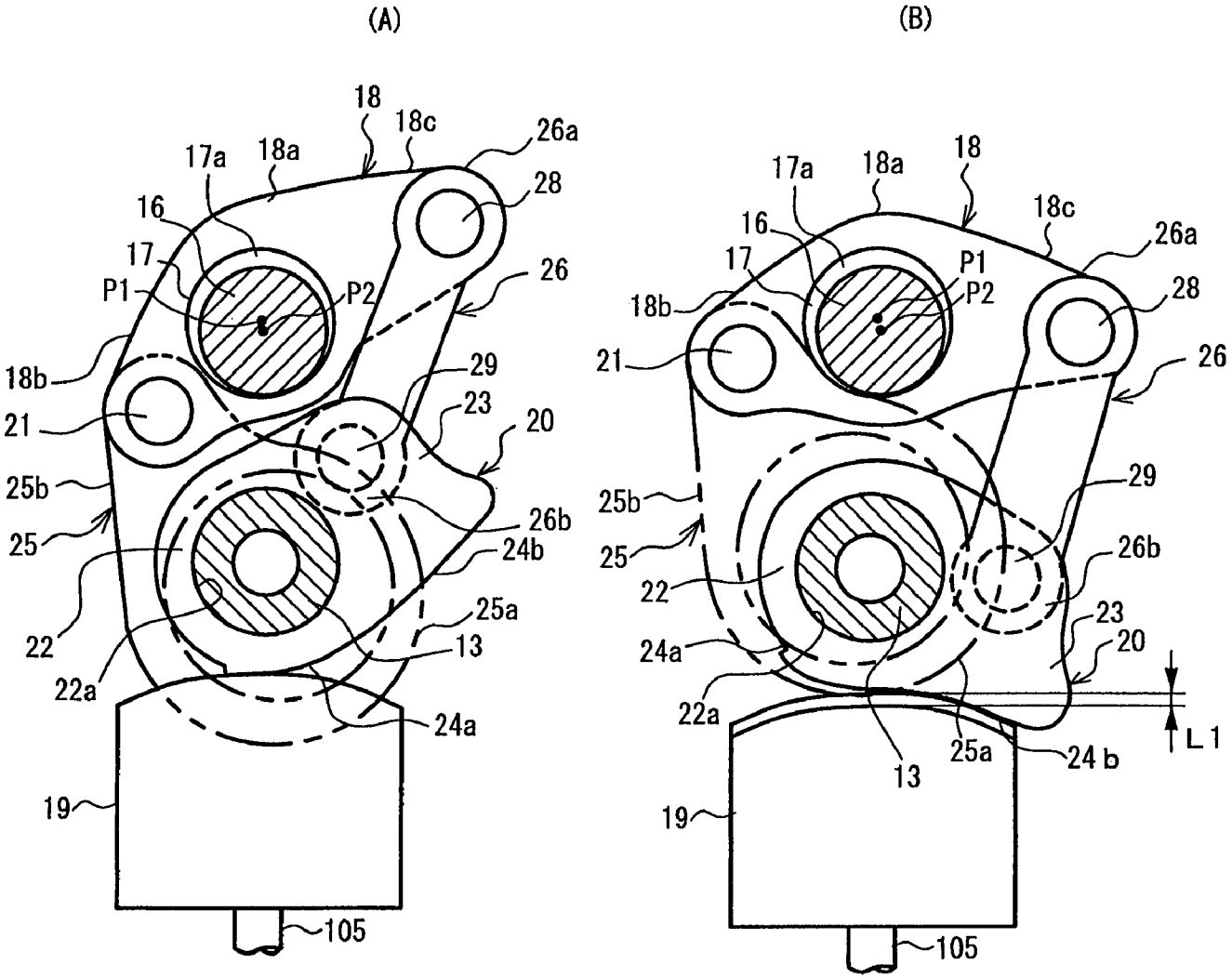
FIG. 6 is a sectional view (taken along B—B in FIG. 3) showing a low-lift state of the Variable valve Event and Lift mechanism.
Figure 7:
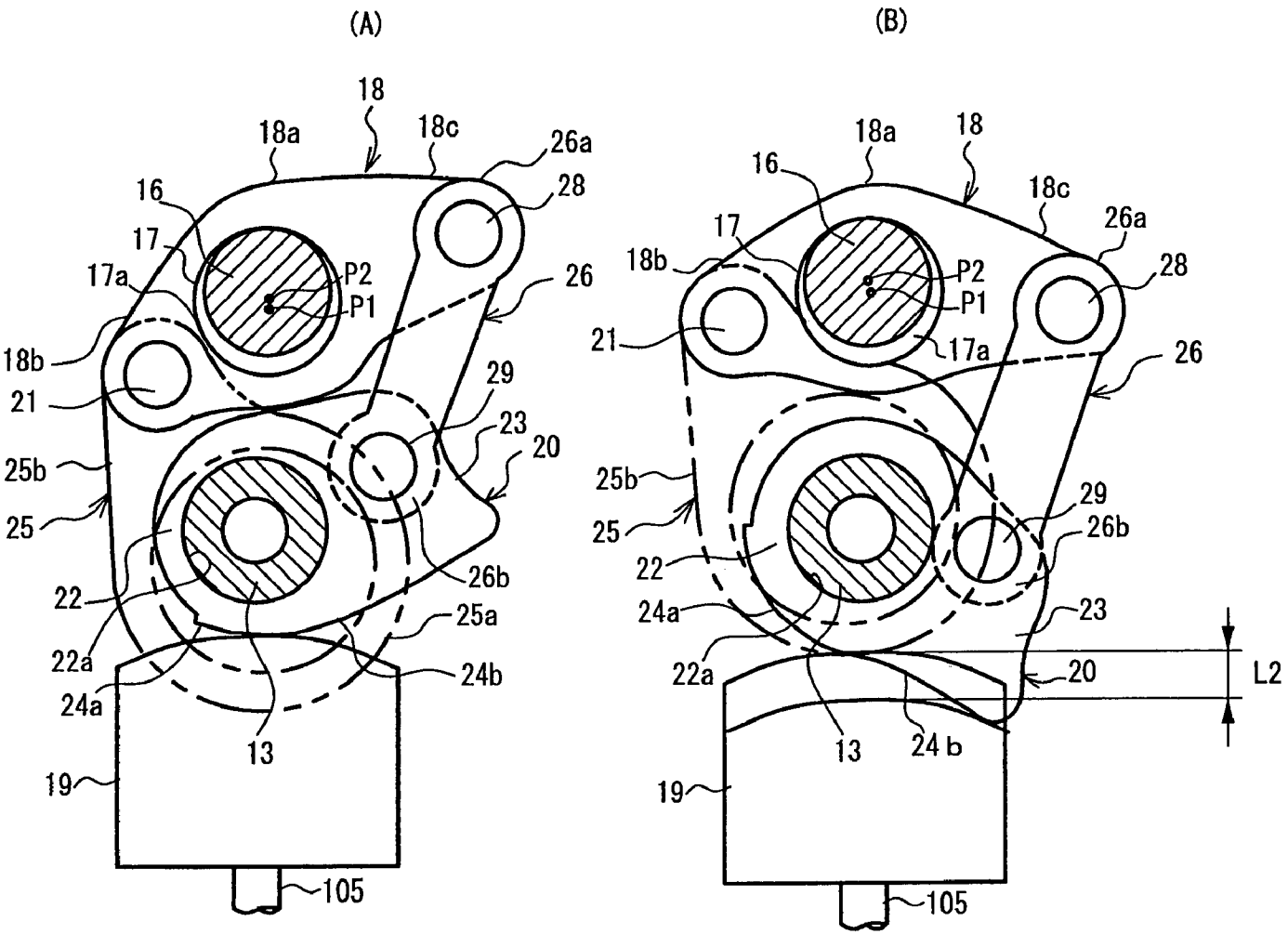
FIG. 7 is a sectional view (taken along B—B in FIG. 3) showing a high-lift state of the Variable valve Event and Lift mechanism.

Rocker cam 20 is, as shown in FIG. 2, FIG. 6, and FIG. 7, substantially a horizontal U-shape, and a bearing hole 22*a* into which camshaft 13 is supported to be freely pivotable by being fitted is formed so as to pass through a substantially ring shaped base end portion 22, and a pin hole 23*a* is formed so as to pass through an end portion 23 positioned at other end portion 18*c* of rocker arm 18.

Further, a basic circular surface 24*a* at base end portion 22 side and a cam surface 24*b* extending so as to be a circular arc shape from basic circular surface 24*a* to an end portion 23 edge side are formed at the bottom surface of rocker cam 20, and basic circular surface 24*a* and cam surface 24*b* are structured so as to touch a predetermined position on the top surface of each valve lifter 19 in accordance with a rocked position of rocker cam 20.

Figure 8:
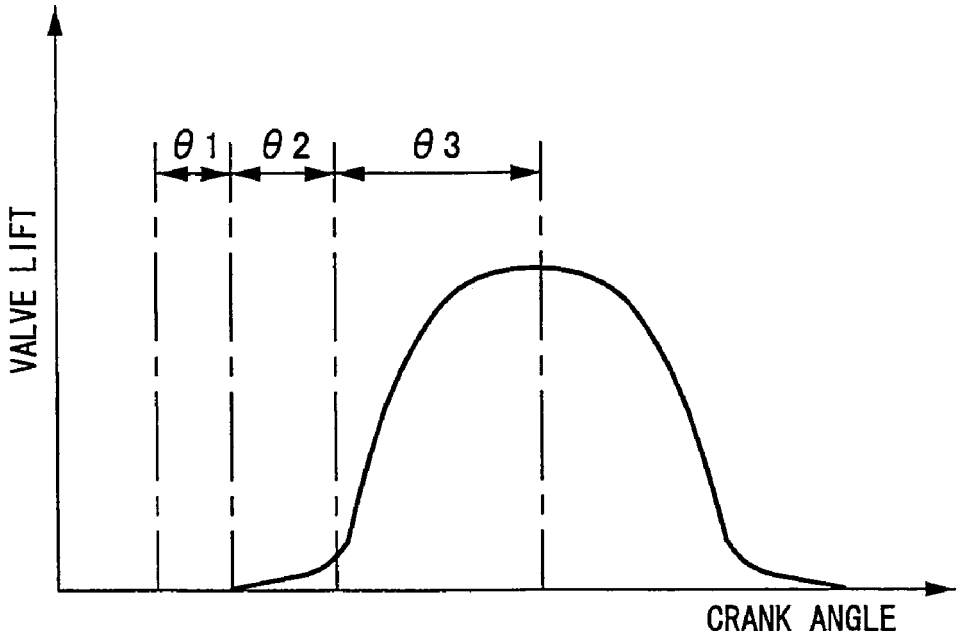
FIG. 8 is a characteristic diagram of a lift in the Variable valve Event and Lift mechanism.

Namely, from the standpoint of the lift characteristic shown in FIG. 8, a predetermined angle range θ1 on basic circular surface 24*a* is set so as to be a base circle zone as shown in FIG. 2, and a zone from base circle zone θ1 to a predetermined angle range θ2 on cam surface 24*b* is set so as to be a so-called ramp zone, and moreover, a zone from ramp zone θ2 to a predetermined angle range θ3 on cam surface 24*b* is set so as to be a lift zone.

Further, link arm 25 has a ring shaped base portion 25*a* and a protruded end 25*b* provided so as to protrude at a predetermined position on the outer peripheral surface of base portion 25*a*, and an fitting-into hole 25*c* which is fitted into the outer peripheral surface of cam main body 15*a* of eccentric cam 15 to be freely pivotable is formed at the central position of base portion 25*a*, and on the other hand, a pin hole 25*d* into which pin 21 is inserted to be freely pivotable is formed so as to pass through protruded end 25*b*.

Moreover, link member 26 is formed in a straight shape with a predetermined length, and pin through holes 26*c* and 26*d* into which the end portions of respective pins 28 and 29 which have been press-fitted into respective pin holes 18*d* and 23*a* of other end portion 18*c* of rocker arm 18 and the end portion of rocker cam 20 are inserted to be freely rotatable are formed so as to pass through circular both end portions 26*a* and 26*b*.

Note that snap rings 30, 31, and 32 regulating the movements in the axis direction of link arm 25 and link member 26 are provided to one end portions of respective pins 21, 28, and 29.

In the above-described structure, as shown in FIGS. 6 and 7, the lift is varied in accordance with a positional relationship between the axis P2 of control shaft 16 and the axis P1 of control cam 17, and the position of the axis P2 of control shaft 16 with respect to the axis P1 of control cam 17 is varied by controlling control shaft 16 to rotate.

Figure 9:
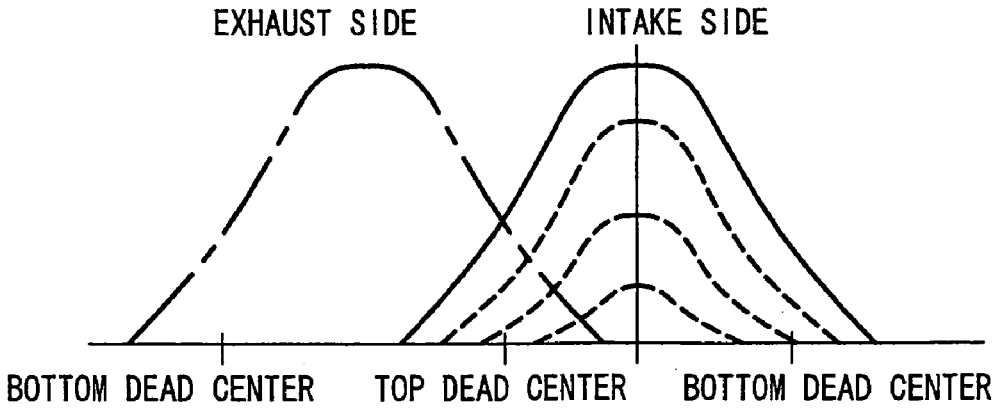
FIG. 9 is a characteristic diagram showing a correlation between an operating angle and a lift in the Variable valve Event and Lift mechanism.
Figure 10:
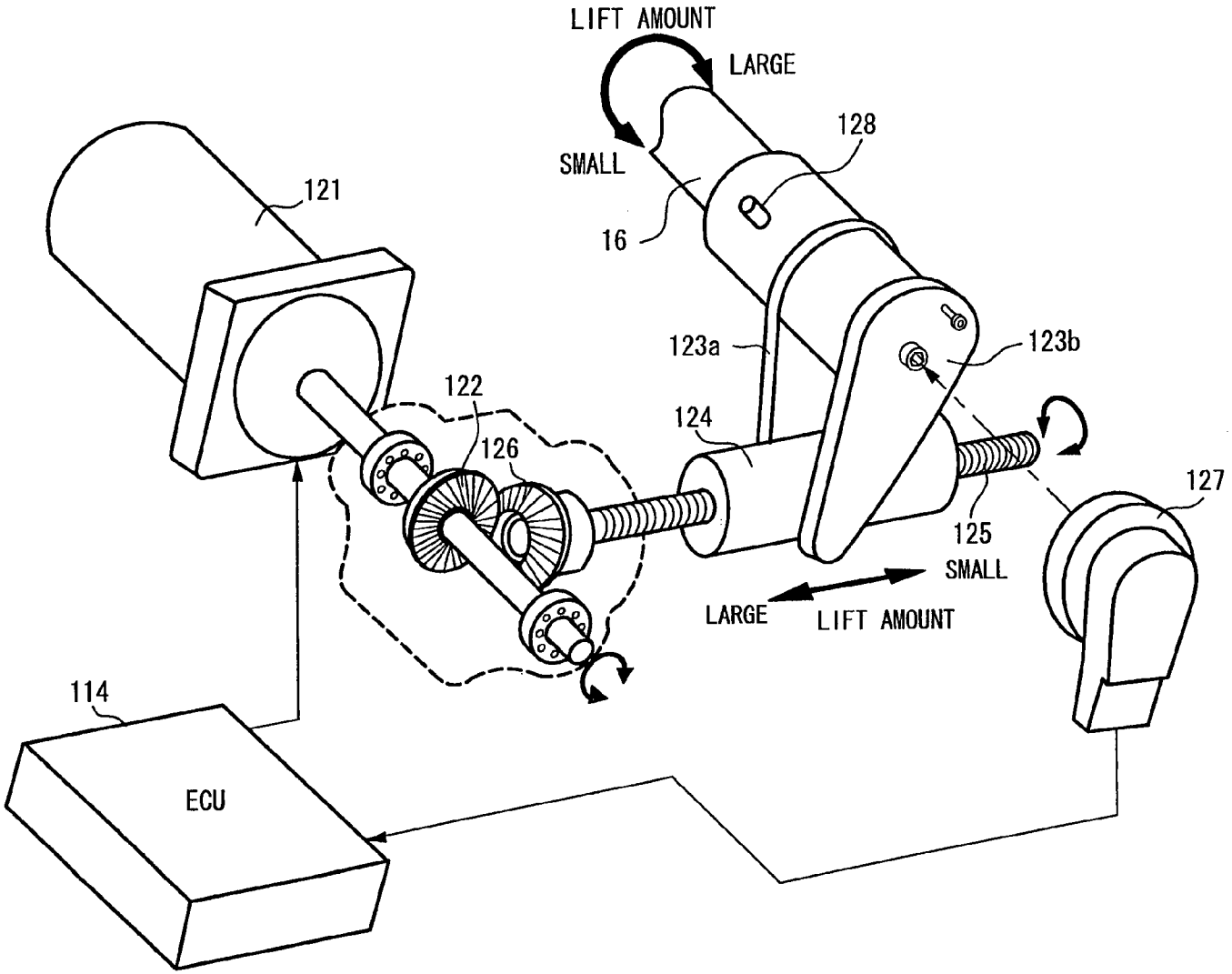
FIG. 10 is a perspective view showing a driving mechanism of a control shaft in the Variable valve Event and Lift mechanism.

Control shaft 16 is, in accordance with a structure as shown in FIG. 10, controlled to rotate by a DC servo motor (actuator) 121 within a predetermined rotational angle range limited by a stopper, and due to the angle of control shaft 16 being varied by actuator 121, the lift and the operating angle of intake valve 105 are sequentially varied within a variable range, which is limited by the stopper, between the maximum lift and the minimum lift (refer to FIG. 9).

In FIG. 10, DC servo motor 121 is disposed such that the rotating shaft thereof is made to be parallel with control shaft 16, and a bevel gear 122 is supported pivotally at the top end of the rotating shaft.

On the other hand, a pair of stays 123*a* and 123*b* are fixed to the top end of control shaft 16, and a nut 124 is supported so as to be rockable at the periphery of the shaft which is parallel with control shaft 16 to which the top end portions of pair of stays 123*a* and 123*b* are connected.

A bevel gear 126 engaged into above-described bevel gear 122 is supported pivotally at the top end of a threaded bar 125 made to engage with above-described nut 124, and threaded bar 125 is made to rotate by a rotation of DC servo motor 121, and a position of nut 124 engaging with threaded bar 125 is displaced in the axis direction of threaded bar 125, and therefore, control shaft 16 is made to rotate.

Here, the direction in which the position of nut 124 is made to approach to bevel gear 126 is a direction in which a valve lift is made small, and in contrast thereto, the direction in which the position of nut 124 is made be away from bevel gear 126 is a direction in which a valve lift is made large.

As shown in FIG. 10, a potentiometer system angle sensor 127 detecting an angle of control shaft 16 is provided at the top end of control shaft 16, and ECU 114 feedback-controls DC servo motor 121 such that an actual angle detected by angle sensor 127 is made to agree with a target angle (a value corresponding to a target lift).

Next, the structure of VTC mechanism 113 will be described with reference to FIG. 12 to FIG. 22.

Figure 12:
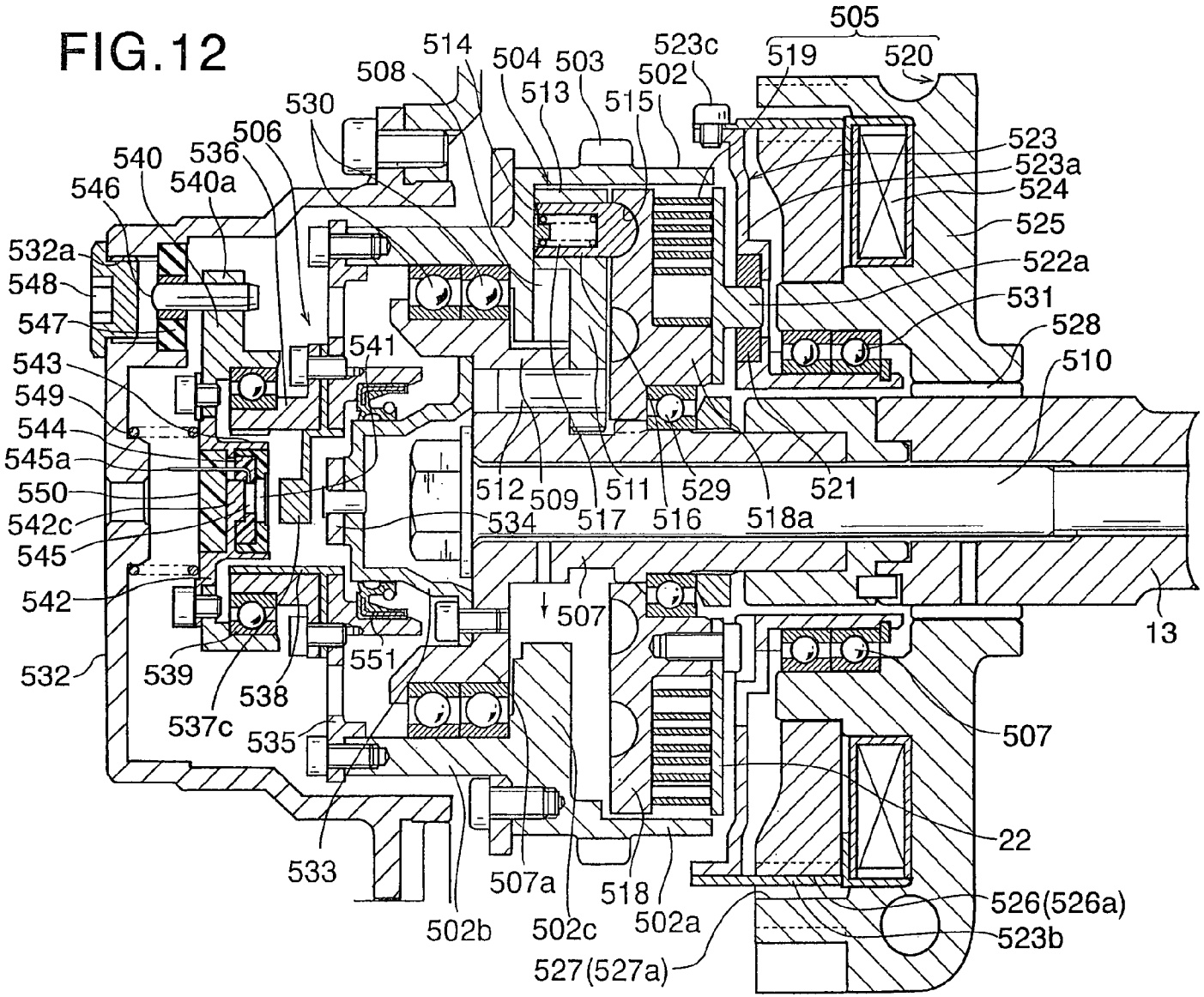
FIG. 12 is a sectional view showing a Variable valve Timing Control mechanism in the embodiment.

As shown in FIG. 12, VTC mechanism 113 has a timing sprocket 502 which is assembled into the front end portion of camshaft 13 so as to be relatively rotatable, and which is made to link with crankshaft 120 via a timing chain (not illustrated), assembling angle changing means 504 which is fixed to the inner periphery of timing sprocket 502, and which changes an assembling angle between timing sprocket 502 and camshaft 13, operating force providing means 505 driving assembling angle changing means 504, relative displacement detecting means 506 detecting an angle of relative rotational displacement of camshaft 13 with respect to timing sprocket 502, and a VTC cover 532 which is fixed to a head cover of the cylinder cover, and which covers the front surfaces of the assembling angle changing means 504 and relative displacement detecting means 506.

A driven shaft member 507 is fixed to the end portion of camshaft 13 by a cam bolt 510.

A flange 507*a* is provided so as to be integrated with driven shaft member 507.

Timing sprocket 502 is formed from a large-diameter cylinder portion 502*a* at which a gear portion 503 with which the timing chain is engaged is formed, a small-diameter cylinder portion 502*b*, and a disk portion 502*c* connecting between cylinder portion 502*a* and cylinder portion 502*b*.

Cylinder portion 502*b* is assembled so as to be rotatable by a ball bearing 530 with respect to flange 507*a* of driven shaft member 507.

Figure 13:
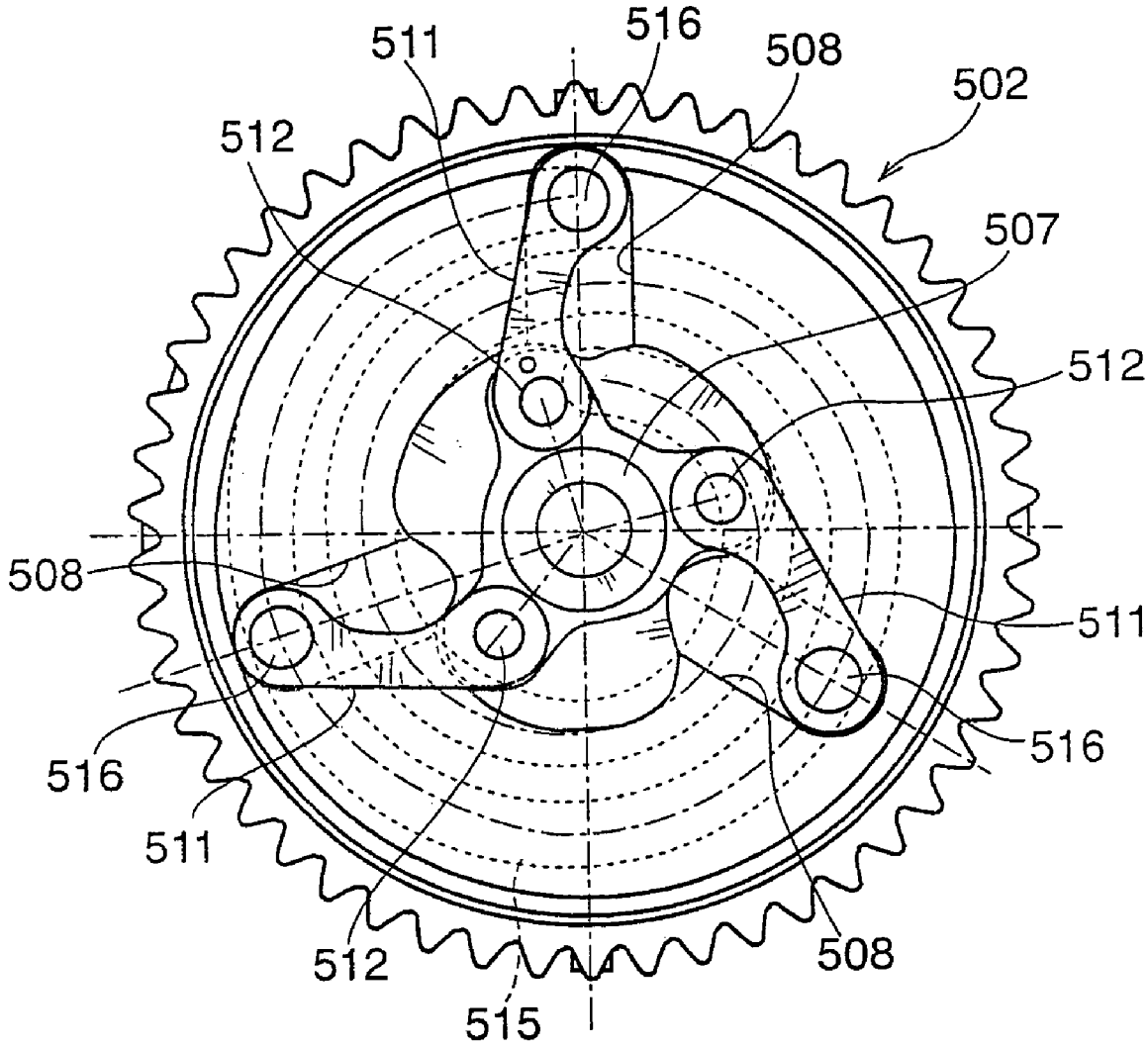
FIG. 13 is a diagram showing the Variable valve Timing Control mechanism in a state of the maximum retard.
Figure 14:
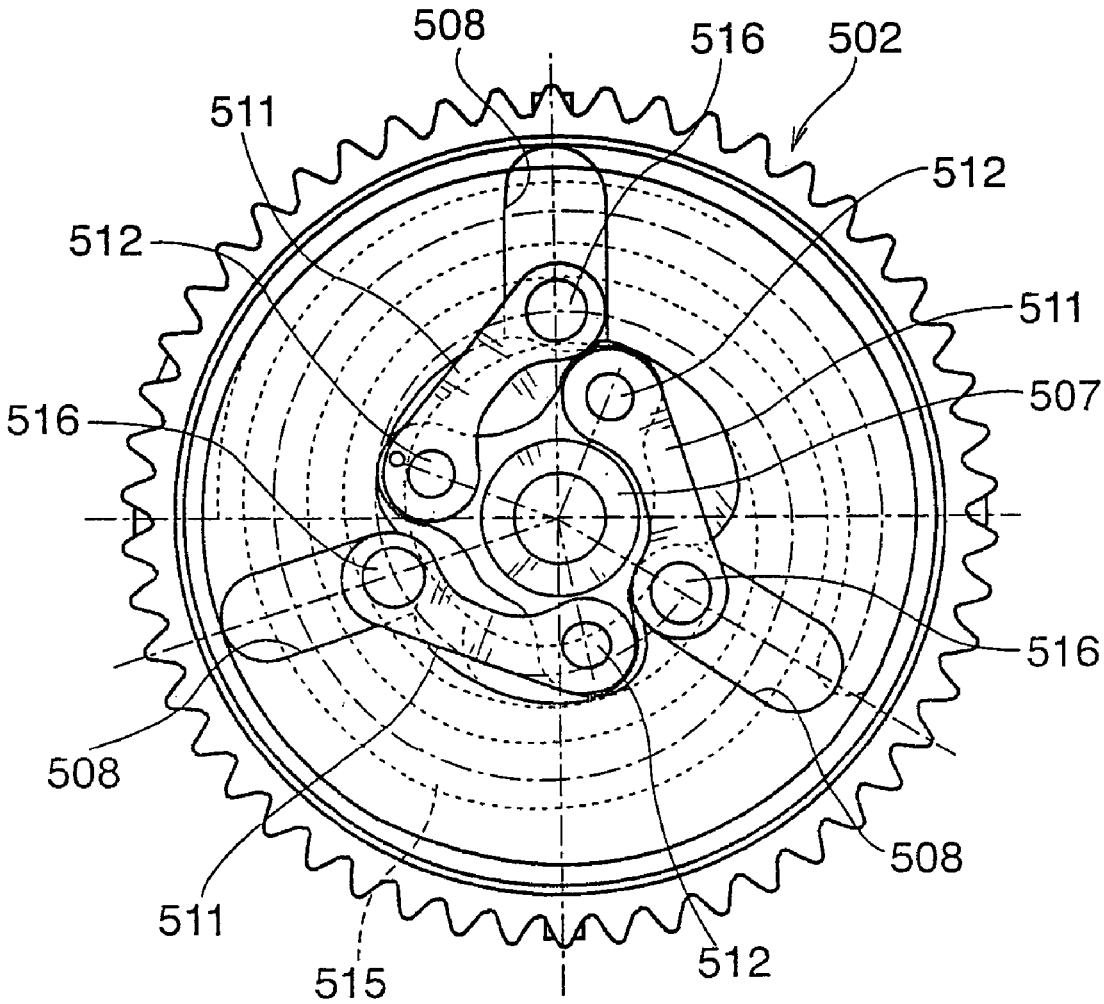
FIG. 14 is a diagram showing the Variable valve Timing Control mechanism in a state of the maximum advance.
Figure 15:
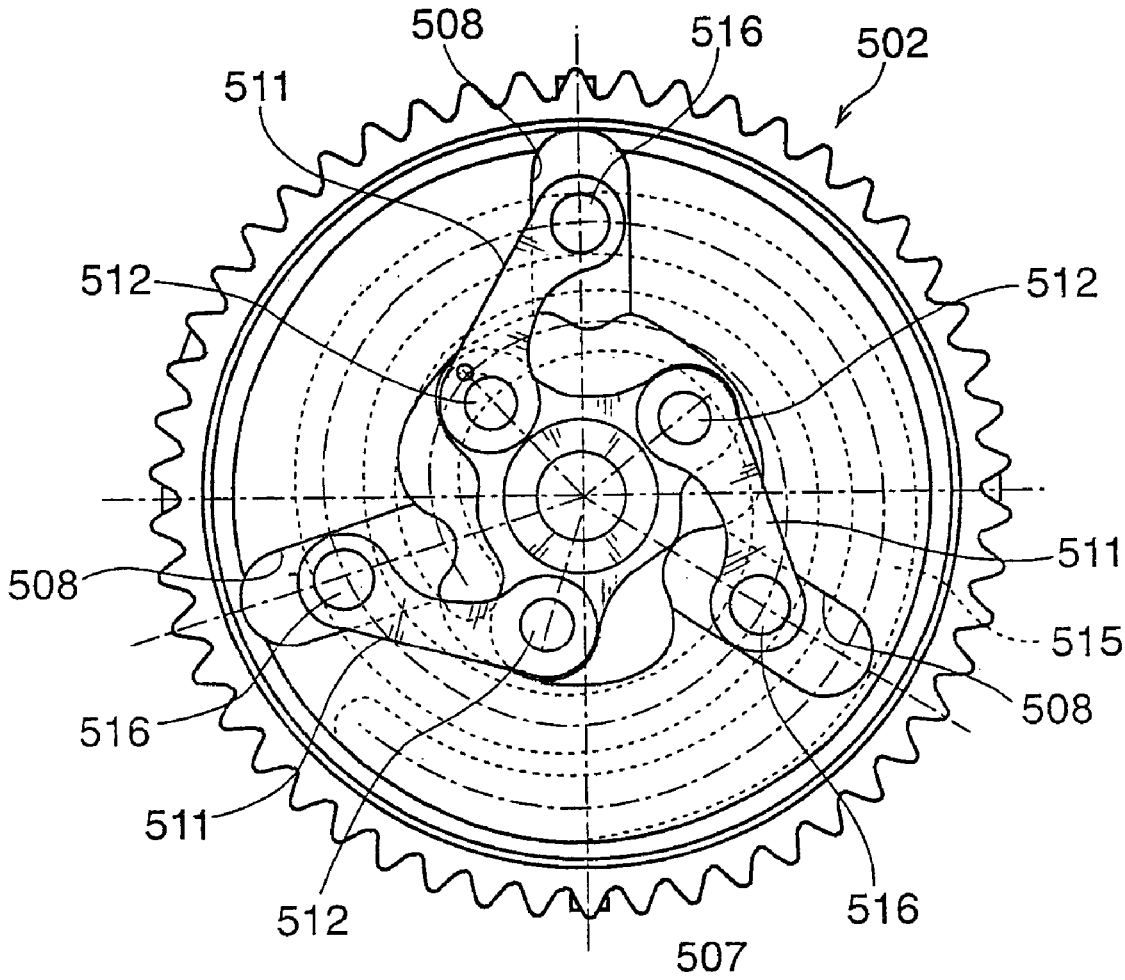
FIG. 15 is a diagram showing the Variable valve Timing Control mechanism in a state of the intermediate advance.

As shown in FIG. 13 to FIG. 15, three grooves 508 are formed in a radial pattern along radial directions of timing sprocket 502 at the surface at cylinder portion 502*b* side of disk portion 502*c*.

Further, three protruding portions 509 protruding in a radial pattern in radial directions are formed so as to be integrated with camshaft 13 side end surface of flange portion 507*a* of driven shaft member 507.

The base ends of three links 511 are respectively connected to respective protruding portions 509 so as to be rotatable by pins 512.

Cylindrical lobes 513 engaging with respective grooves 508 so as to be freely rockable are formed so as to be integrated with the top ends of respective links 511.

Because respective links 511 are connected to driven shaft member 507 via pins 512 in a state in which respective lobes 513 engage with corresponding grooves 508, when the top end sides of links 511 are displaced along grooves 508 by receiving external force, timing sprocket 502 and driven shaft member 507 are relatively rotated by the effects of respective links 511.

Further, accommodating holes 514 opening toward camshaft 13 side are formed at lobes 513 of respective links 511.

An engagement pin 516 engaging with a spiral slot 515 which will be described later, and a coil spring 517 urging engagement pin 516 against spiral slot 515 side are accommodated in accommodating hole 514.

On the other hand, a disk type intermediate rotator 518 is supported to be freely pivotable via a bearing 529 at driven shaft member 507 which is further at camshaft 13 side than protruding portion 509.

Spiral slot 515 is formed at the end surface at protruding portion 509 side of intermediate rotator 518, and engagement pins 516 at the top ends of respective links 511 are engaged with spiral slot 515.

Spiral slot 515 is formed so as to gradually reduce the diameter along the rotational direction of timing sprocket 502.

Accordingly, when intermediate rotator 518 is relatively displaced in the retard direction with respect to timing sprocket 502 in a state in which respective engagement pins 516 engage with spiral slot 515, the top end portions of respective links 511 are moved toward the inside in the radial direction by being led by spiral slot 515 while being guided by grooves 508.

In contrast thereto, when intermediate rotator 518 is relatively displaced in the advance direction with respect to timing sprocket 502, the top end portions of respective links 511 are moved toward the outside in the radial direction.

Assembling angle changing means 504 is structured from grooves 508, links 511, lobes 513, engagement pins 516, intermediate rotator 518, spiral slot 515, and the like of timing sprocket 502.

When an operating force for rotations is inputted from operating force providing means 505 to intermediate rotator 518, the top ends of links 511 are displaced in radial directions, and the displacement is transmitted as a turning force which varies an angle of the relative displacement between timing sprocket 502 and driven shaft member 507 via links 511.

Operating force providing means 505 has a spiral spring 519 urging intermediate rotator 518 in the rotational direction of timing sprocket 502, and a hysteresis brake 520 generating braking force which rotates intermediate rotator 518 in a direction opposite to the rotational direction of timing sprocket 502.

Here, ECU 114 controls the braking force of hysteresis brake 520 in accordance with a operating state of internal combustion engine 101, and in accordance therewith, intermediate rotator 518 can be relatively rotated with respect to timing sprocket 502 up to a position where the urging force of spiral spring 519 and the braking force of hysteresis brake 520 are made to be in balance.

Figure 16:
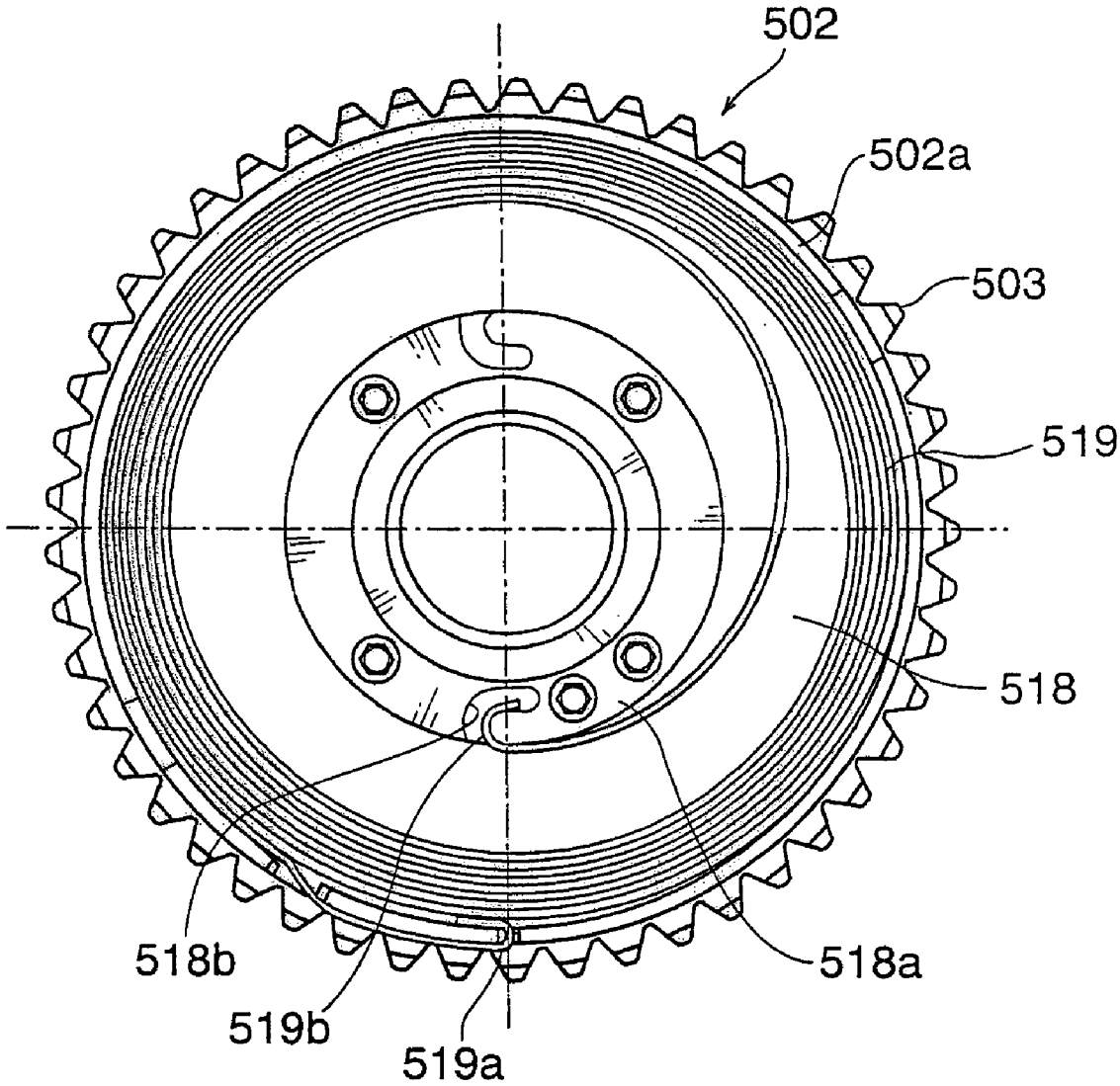
FIG. 16 is a diagram showing a state of attaching a spiral spring in the Variable valve Timing Control mechanism.
Figure 17:
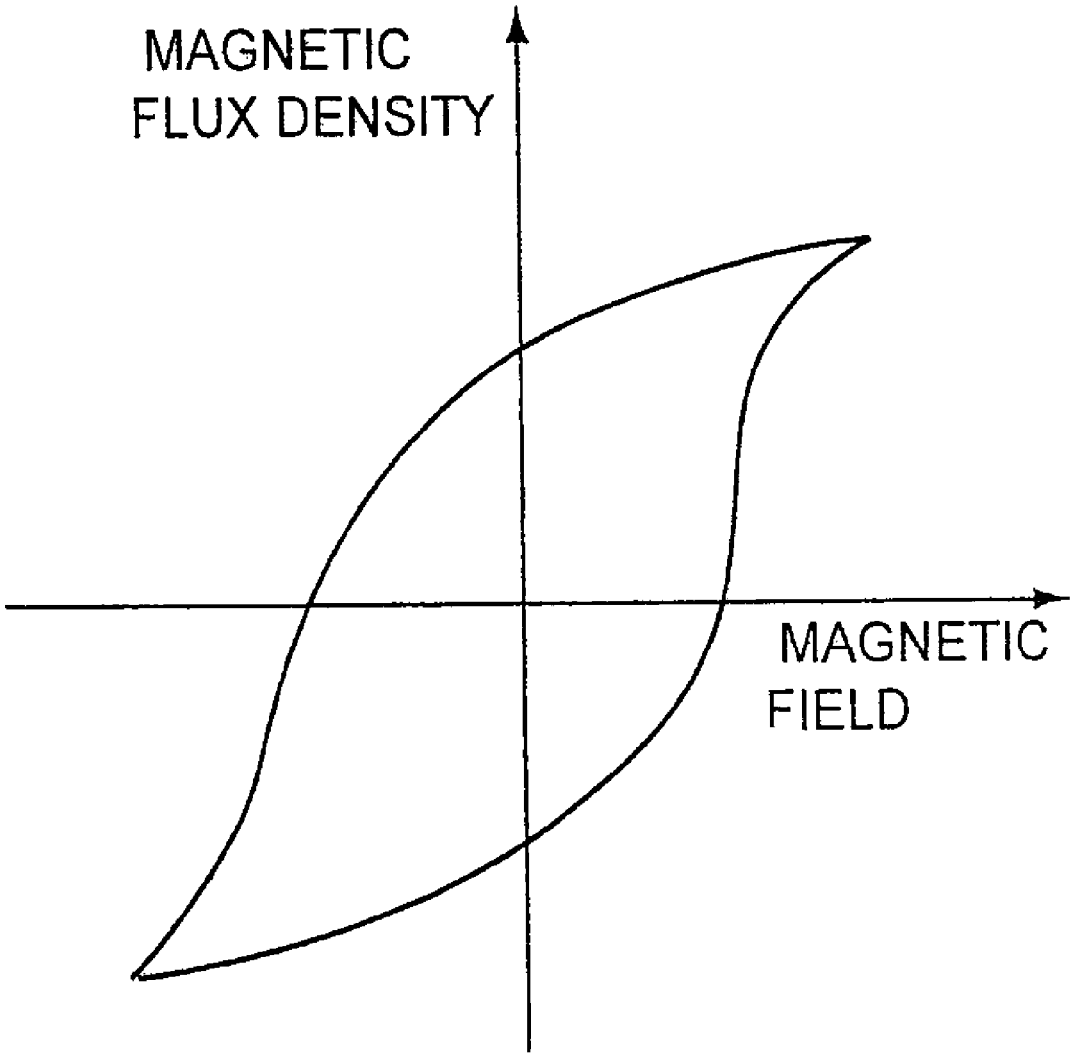
FIG. 17 is a graph showing a characteristic of a variation in a magnetic flux density of a hysteresis material in the Variable valve Timing Control mechanism.

As shown in FIG. 16, spiral spring 519 is disposed in cylinder portion 502*a* of timing sprocket 502, and an outer peripheral end portion 519*a* is engaged with the inner periphery of cylinder portion 502*a*, and an inner peripheral end portion 519*b* is engaged with an engagement slot 518*b* of a base portion 518*a* of intermediate rotator 518.

Hysteresis brake 520 has a hysteresis ring 523, an electromagnetic coil 524 serving as magnetic field control means, and a coil yoke 525 inducing magnetism of electromagnetic coil 524.

Hysteresis ring 523 is attached to the rear end portion of intermediate rotator 518 via a retainer plate 522 and a protrusion 522*a* provided so as to be integrated with the rear end surface of retainer plate 522.

Energizing (exciting current) to electromagnetic coil 524 is controlled by ECC 114 in accordance with a operating state of the engine.

Hysteresis ring 523 is structure from a disk type base portion 523*a*, and a cylinder portion 523*b* connected to the outer periphery side of base portion 523*a* via a screw 523*c*.

It is structured such that base portion 523*a* is connected to retainer plate 522 due to respective protrusions 522*a* being press-fitted into bushes 521 provided at positions at uniform intervals in the circumferential direction.

Further, hysteresis ring 523 is formed from a material having the characteristic that the magnetic flux is varied so as to have a phase delay with respect to a variation in the external magnetic field (refer to FIG. 17), and cylinder portion 523*b* receives braking effect by coil yoke 525.

Coil yoke 525 is formed so as to surround electromagnetic coil 524, and the outer peripheral surface thereof is fixed to a cylinder head out of the drawing.

Further, the side of the inner periphery of coil yoke 525 supports camshaft 13 to be freely pivotable via a needle bearing 528, and base portion 523*a* side of hysteresis ring 523 is supported so as to freely pivotable by a ball bearing 531.

Then, a pair of facing surfaces 526 and 527 which face one another via a ring-shaped gap are formed at intermediate rotator 518 side of coil yoke 525.

Figure 18:
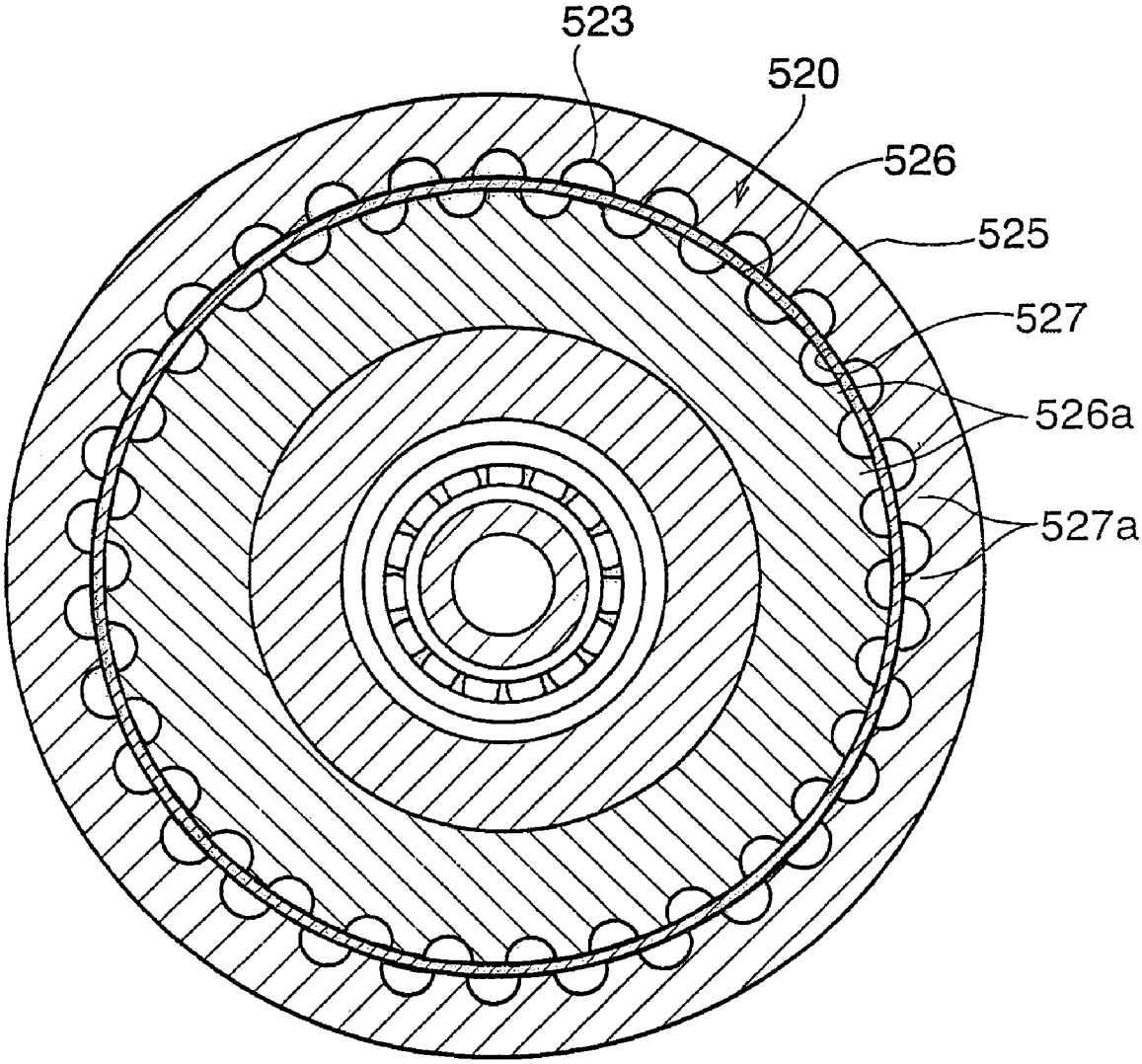
FIG. 18 is a diagram showing a hysteresis brake in the Variable valve Timing Control mechanism.

As shown in FIG. 18, a plurality of convex portions 526*a* and 527*a* which structure a magnetic field generating unit are formed at uniform intervals along the circumferential direction at facing surfaces 526 and 527.

Then, convex portions 526*a* on the one facing surface 526 and convex portions 527*a* on other facing surface 527 are disposed alternately in the circumferential direction, and adjacent convex portions 526*a* and 527*a* of facing surfaces 526 and 527 are entirely shifted in the circumferential direction.

Figure 19:
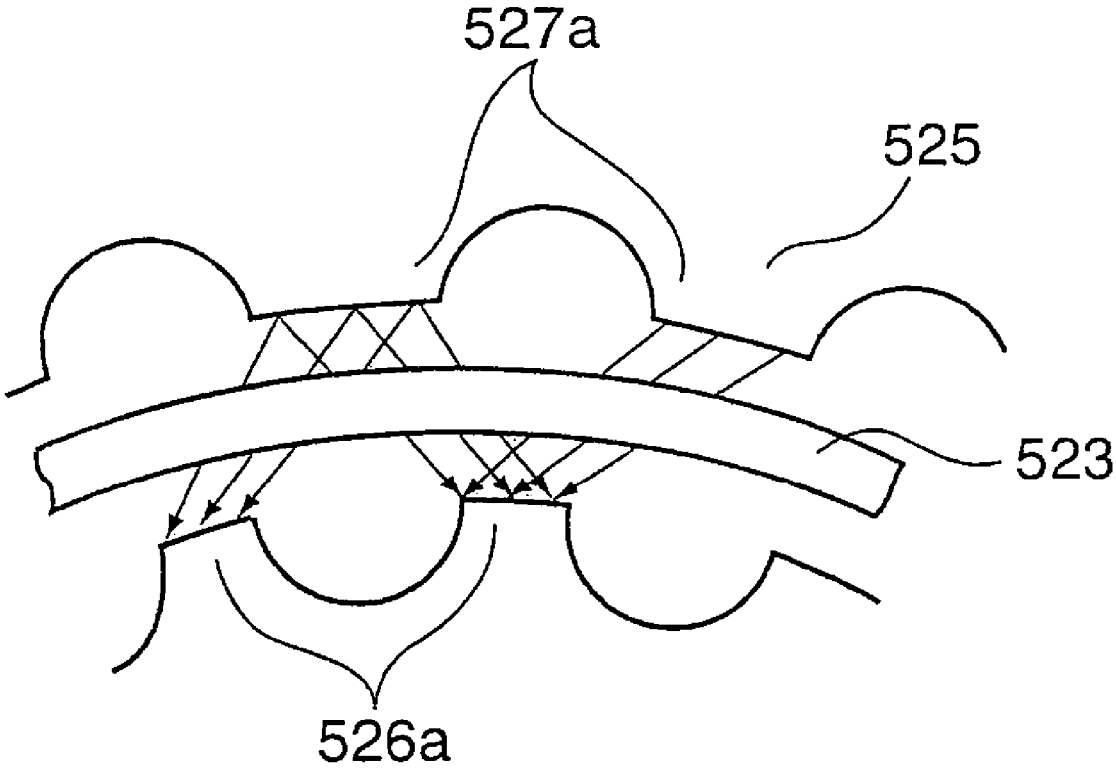
FIG. 19 is a diagram showing directions of magnetic fields in the hysteresis brake.

Accordingly, a magnetic field in the direction deflected in the circumferential direction is generated between convex portions 526*a* and 527*a* adjacent to one another of facing surfaces 526 and 527 by excitation of electromagnetic coil 524 (refer to FIG. 19).

Then, cylinder portion 523*a* of hysteresis ring 523 is set in the gap between the both facing surfaces 526 and 527 in a non-contacting state.

When hysteresis ring 523 is displaced in the magnetic field between facing surfaces 526 and 527, braking force is generated due to a divergence between the direction of the magnetic flux and the direction of the magnetic field inside hysteresis ring 523.

The braking force is made to be a value which is substantially in proportion to the strength of the magnetic field, i.e., a magnitude of an exciting current of electromagnetic coil 524 regardless of a relative velocity between facing surfaces 526 and 527 and hysteresis ring 523.

Figure 20:
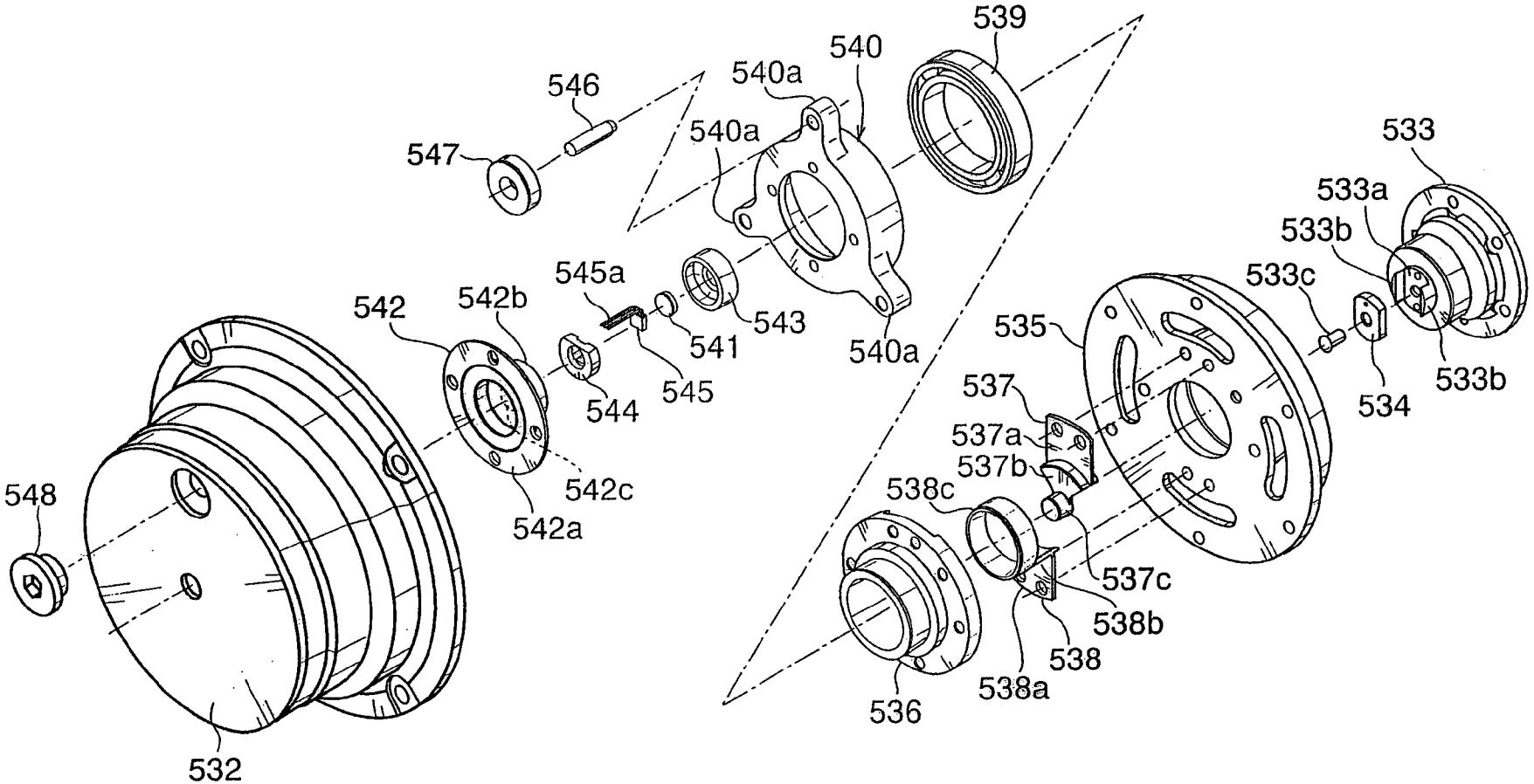
FIG. 20 is an exploded perspective view showing relative displacement detecting means in the Variable valve Timing Control mechanism.
Figure 21:
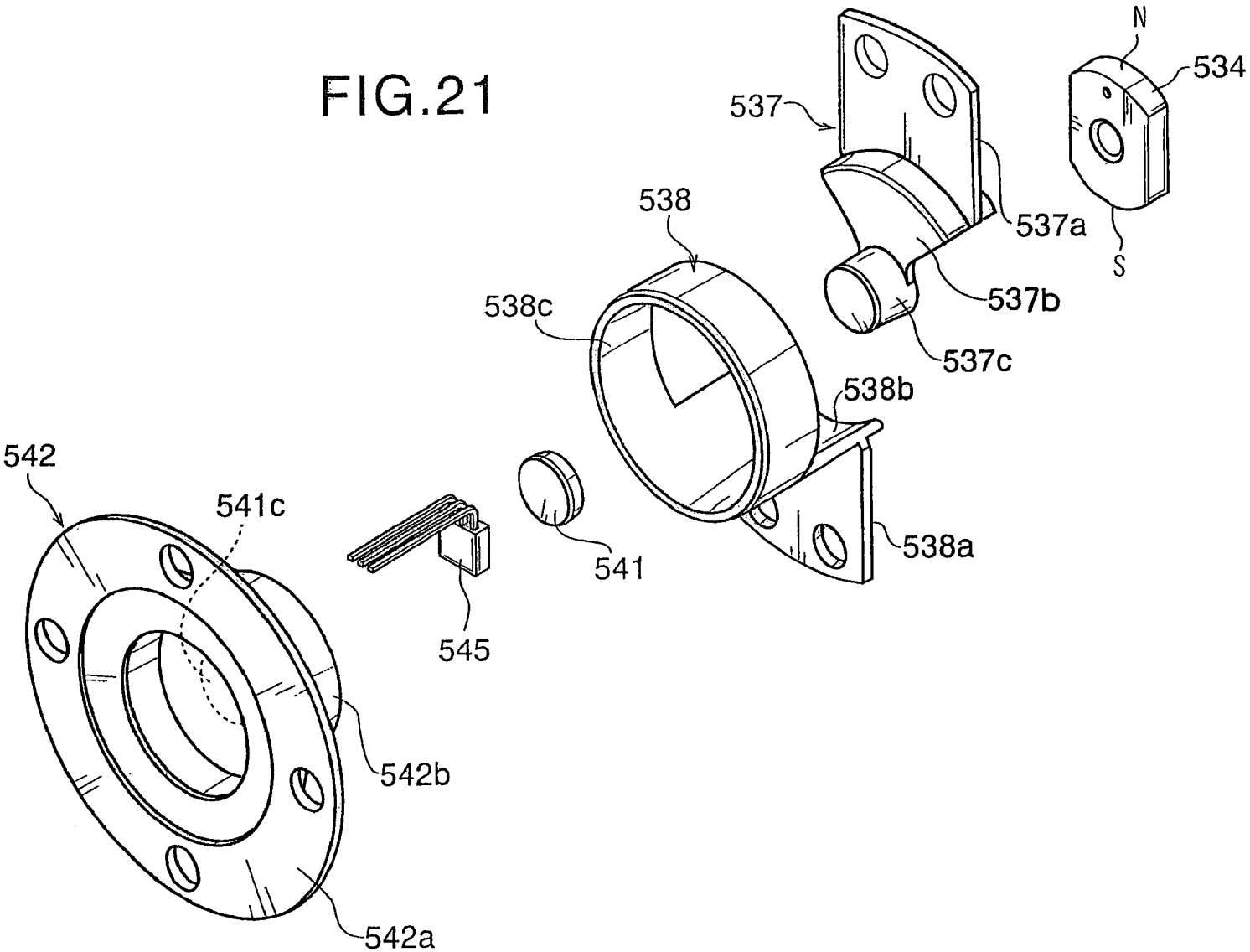
FIG. 21 is elements on large scale of FIG. 20.

As shown in FIG. 12, FIG. 20, and FIG. 21, relative displacement detecting means 506 is structured from a magnetic field generating mechanism provided at driven shaft member 507 side, and a sensor mechanism which is provided at VTC cover 532 side which is the fixing unit side, and which detects a variation in a magnetic field from the magnetic field generating mechanism.

The magnetic field generating mechanism has a magnet base 533 formed from a non-magnetic material fixed at the front end side of flange 507*a*, a permanent magnet 534 which is accommodated in a groove 533*a* formed at the top end portion of magnet base 533, and which is fixed by a pin 533*c*, a sensor base 535 fixed at the top end edge of cylinder portion 502*b* of timing sprocket 502, and a first yoke member 537 and a second yoke member 538 which are fixed at the front end surface of sensor base 535 via a cylindrical yoke holder 536.

Note that a seal member 551 preventing dirt and the like from entering the sensor mechanism is set between the outer peripheral surface of magnet base 533 and the inner peripheral surface of sensor base 535.

As shown in FIG. 20, magnet base 533 has a set of protruded walls 533*b* and 533*b* forming groove 533*a* whose top and bottom are opened, and permanent magnet 534 is accommodated between both protruded walls 533*b* and 533*b*.

Permanent magnet 534 is formed in a long elliptical shape in a direction of elongating groove 533*a*, and the center of the top end portion and the center of the bottom end portion are set to the centers of the north pole and the south pole.

As shown in FIG. 20 and FIG. 21, first yoke member 537 is structured from a plate shaped base portion 537*a* fixed to sensor base 535, a fan shaped yoke portion 537*b* provided so as to be integrated with the inner peripheral edge of base portion 537*a*, and a cylindrical central yoke portion 537*c* provided so as to be integrated with a main portion of fan shaped yoke portion 537*b*.

The rear end surface of central yoke portion 537*c* is disposed at the front surface of permanent magnet 534.

Second yoke member 538 is structured from a plate shaped base portion 538*a* fixed to sensor base 535, a plate shaped circular arc yoke portion 538*b* provided so as to be integrated with the upper peripheral edge of base portion 538*a*, and a ring yoke portion 538*c* provided so as to be integrated with the rear end portion of circular arc yoke portion 538*b* in a same curvature.

Ring yoke portion 538*c* is disposed so as to surround the outer peripheral side of a fourth yoke member 542 which will be described later.

The sensor mechanism has a ring shaped element holder 540, a third yoke member 541 serving as a rectifying yoke, a bottled cylinder shaped forth yoke member 542 serving as a rectifying yoke, a synthetic resin protective cap 543, a protective member 544, and a Hall element 545.

Element holder 540 is disposed at the inside of VTC cover 532, and supports the front end portion of yoke holder 536 so as to be freely rotatable by a ball bearing 539 at the inner peripheral side.

Third yoke member 541 is disposed so as to face central yoke portion 537*c* of first yoke member 537 via an air gap G.

Fourth yoke member 542 is fixed to the inner periphery of element holder 540 by a bolt.

Protective cap 543 is fixed to the inner peripheral surface of the cylinder portion of fourth yoke member 542, and supports third yoke member 541.

Protective member 544 is fitted into to be attached to the outer periphery of a cylindrical protrusion 542*c* provided so as to be integrated with the center of the bottom wall of fourth yoke member 542.

Hall element 545 is maintained between third yoke member 541 and protrusion 542*c* of fourth yoke member 542, and a lead wire 545*a* is pulled out of Hall element 545.

At element holder 540, as shown in FIG. 20, three protruding portions 540*a* are integrally provided at uniform intervals in the circumferential direction, and ends of pins 546 are respectively fixed to be press-fitted into fixing holes provided by drilling respective protruding portions 540*a*.

Further, three of holes 532*a* are formed at uniform intervals in the circumferential direction at the inner side of VTC cover 532, and rubber bushes 547 are respectively fixed to the insides of holes 532*a*.

The other end portions of pins 546 are inserted into the holes drilled at the centers of rubber bushes 547, and in accordance therewith, element holder 540 is supported at VTC cover 532.

Further, as shown in FIG. 12, the outer race of bail bearing 539 is fixed so as to be press-fitted into element holder 540.

Further, the outer race of ball bearing 539 is energized in the direction of camshaft 13 due to a spring force of a coil spring 549 set between the inner surface of VTC cover 532 and fourth yoke member 542, and in accordance therewith, positioning in the axis direction is carried out, and generation of looseness is prevented.

Note that a stopper body 548 choking the openings at the outer sides of respective holding holes 506*a* is screwed up on VTC cover 532.

Third yoke member 541 is formed in a disk type, and is disposed so as to face central yoke member 537*c* of first yoke member 537 from the axis direction with an air gap G of a predetermined width (about 1 mm).

Further, an air gap G1 is formed between the inner peripheral surface of ring yoke portion 538*c* of second yoke member 538 and an outer peripheral surface of cylinder portion 542*b* of fourth yoke member 542.

Fourth yoke member 542 has a disk type base portion 542*a* fixed to element holder 540, a small-diameter cylinder portion 542*b* which is provided so as to be integrated with the side end surface of Hall element 545 of base portion 542*a*, and a protrusion 542*c* provided at the bottom wall surrounded by cylinder portion 542*b*.

Protrusion 542*c* is disposed coaxially with permanent magnet 534, central yoke member 537*c* of first yoke member 537, and third yoke member 541.

Lead wire 545*a* of Hall element 545 is connected to ECU 114.

In accordance with VTC mechanism 113 with the above-described structure, during the time when the engine is stopped, due to electromagnetic coil 524 of hysteresis brake 520 being turned off, intermediate rotator 518 is made to rotate at the maximum in the direction in which the engine is rotated with respect to timing sprocket 502 by the force of spiral spring 519 (refer to FIG. 13), and the centric phase of the operating angle of intake valve 105 is maintained at the maximum retard side.

Then, the engine is started to operate from this state, and when electromagnetic coil 524 of hysteresis brake 520 is exited on the basis of a request to vary the centric phase to be at the advance side, braking force against the force of spiral spring 519 is applied to intermediate rotator 518.

In accordance therewith, intermediate rotator 518 is rotated in a direction opposite to timing sprocket 502, and in accordance therewith, engagement pins 516 at the top ends of links 511 are led to spiral slot 515, and the top end portions of links 511 are displaced inward along groove 508 in the radial direction.

Then, as shown in FIG. 14 and FIG. 15, an assembling angle between timing sprocket 502 and driven shaft member 507 is varied to be at the advance side due to the effects of links 511, and the variation to being at the advance side is controlled in accordance with a magnitude of an exciting current of electromagnetic coil 524.

Note that FIG. 14 shows a state at a maximum advance, and FIG. 15 shows a state at an intermediate advance.

Detection of a relative displacement angle by relative displacement detecting means 506 is carried out as follows.

Figure 22:
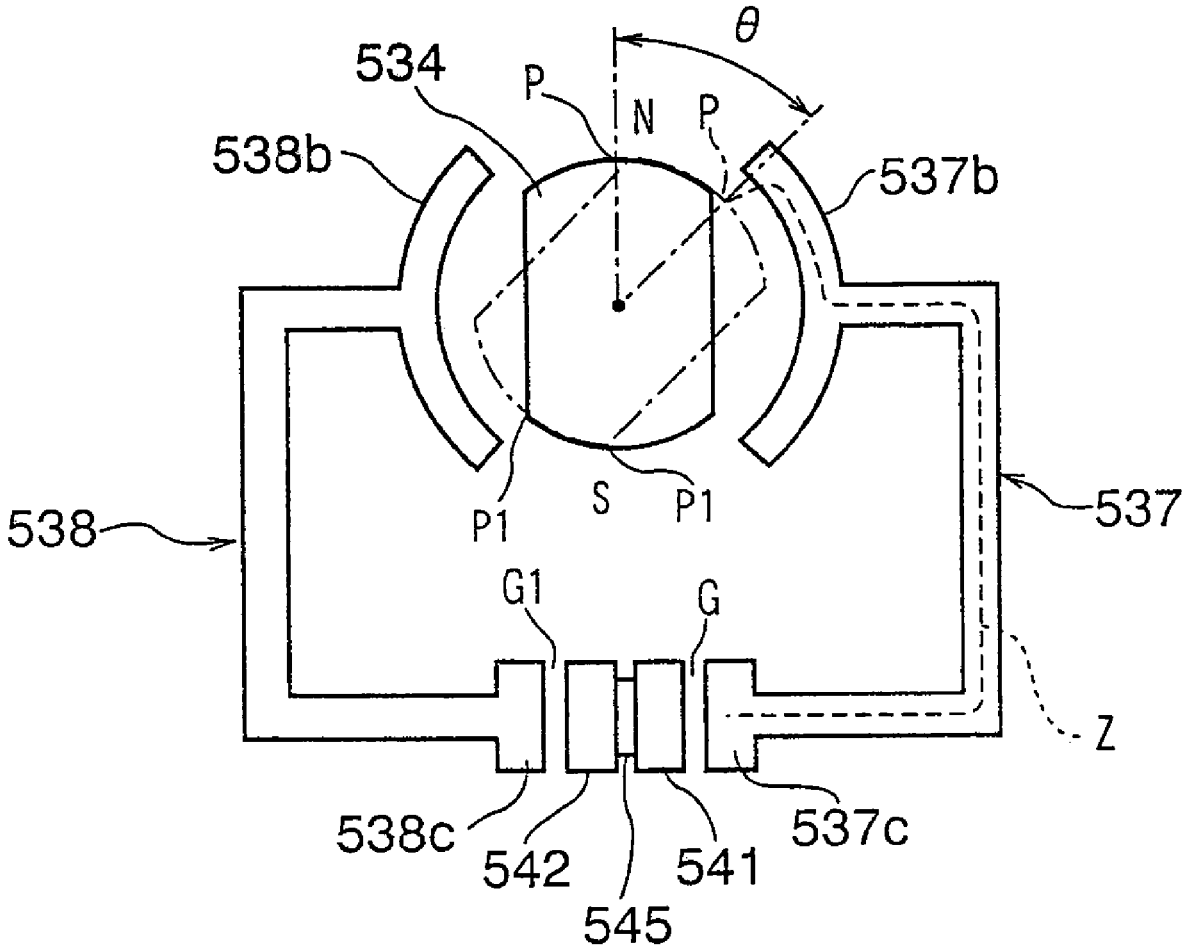
FIG. 22 is a diagram showing a magnetic characteristic in the relative displacement detecting means.

A relative rotational phase between camshaft 13 and timing sprocket 502 is varied, and when permanent magnet 534 of relative displacement detecting means 506 is rotated, for example, by an angle of θ as shown in FIG. 22, a magnetic field Z outputted from the center P of the north pole is transmitted to fan shaped yoke portion 537*b* of first yoke member 537, and is transmitted to central yoke member 537*c*, and moreover, the magnetic field Z is transmitted to Hall element 545 through third yoke member 541 via the air gap G.

The magnetic field Z which has been transmitted to Hall element 545 is transmitted to cylinder portion 542*b* via protrusion 542*c* of fourth yoke member 542 from Hall element 545, and is further transmitted to ring yoke portion 538*c* of second yoke member 538 via the air gap G1, and is returned to the south pole of permanent magnet 534.

Then, because the magnetic flux density of the magnetic field Z is sequentially varied due to the rotational angle θ of permanent magnet 534 being sequentially varied, the sequential variation in the magnetic flux density is detected by Hall element 545, and a variation in the voltages thereof is outputted to ECU 114.

At ECU 114, a relative rotational displacement angle (a advance value of a rotational phase) of camshaft 13 with respect to crankshaft 120 is found by a computation on the basis of the sequential detection signals (variation in the voltages) outputted from Hall element 545 via lead wire 545*a*.

Further, ECU 114 computes a advance target of the rotational phase in VTC mechanism 113, and feedback-controls an exciting current of electromagnetic coil 524 so as to make an actual rotational phase agree with the advance target.

Figure 23:
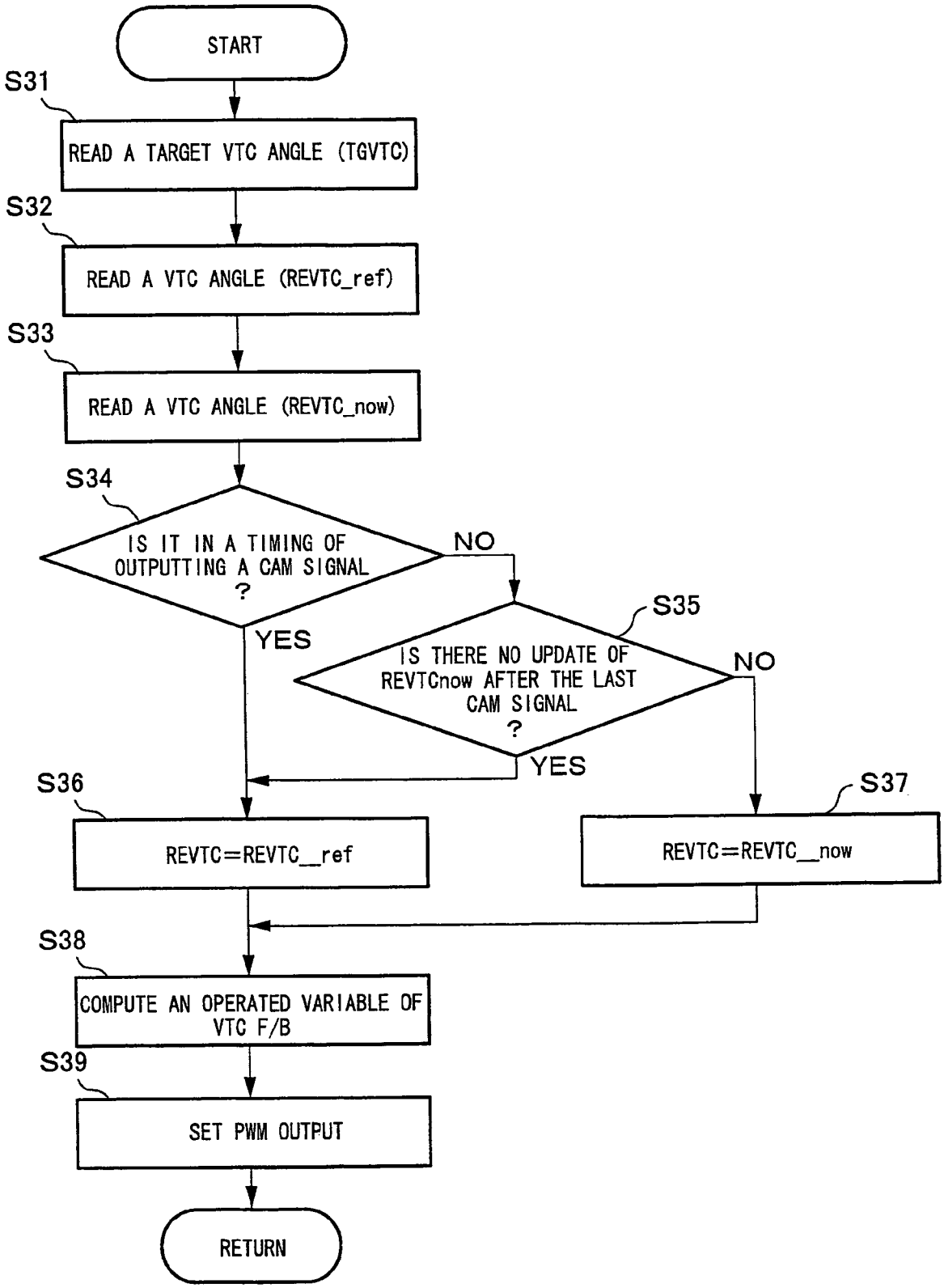
FIG. 23 is a flowchart showing feedback control in the Variable valve Timing Control mechanism.

The flowchart of FIG. 23 shows the main routine of feedback-control of VTC mechanism 113 by ECU 114.

First, at step S31, a target VTC angle TGVTC which is a advance target of a rotational phase of camshaft 13 with respect to crankshaft 120 is read.

At step S32, a latest advance value REVTCref of the rotational phase detected on the basis of an angle from a reference rotational position of crankshaft 120 to a reference rotational position of camshaft 13 is read.

The detection of the rotational phase based on the reference rotational positions is carried out by counting the unit angle signals POS at an angle from a reference rotational position of crankshaft 120 detected by detecting a position at which a unit angle signal POS from crank angle sensor 117 is omitted up to a position at which a cam signal CAM (a head signal at each crank angle of 180°) is outputted from first cam sensor 132.

Figure 24:
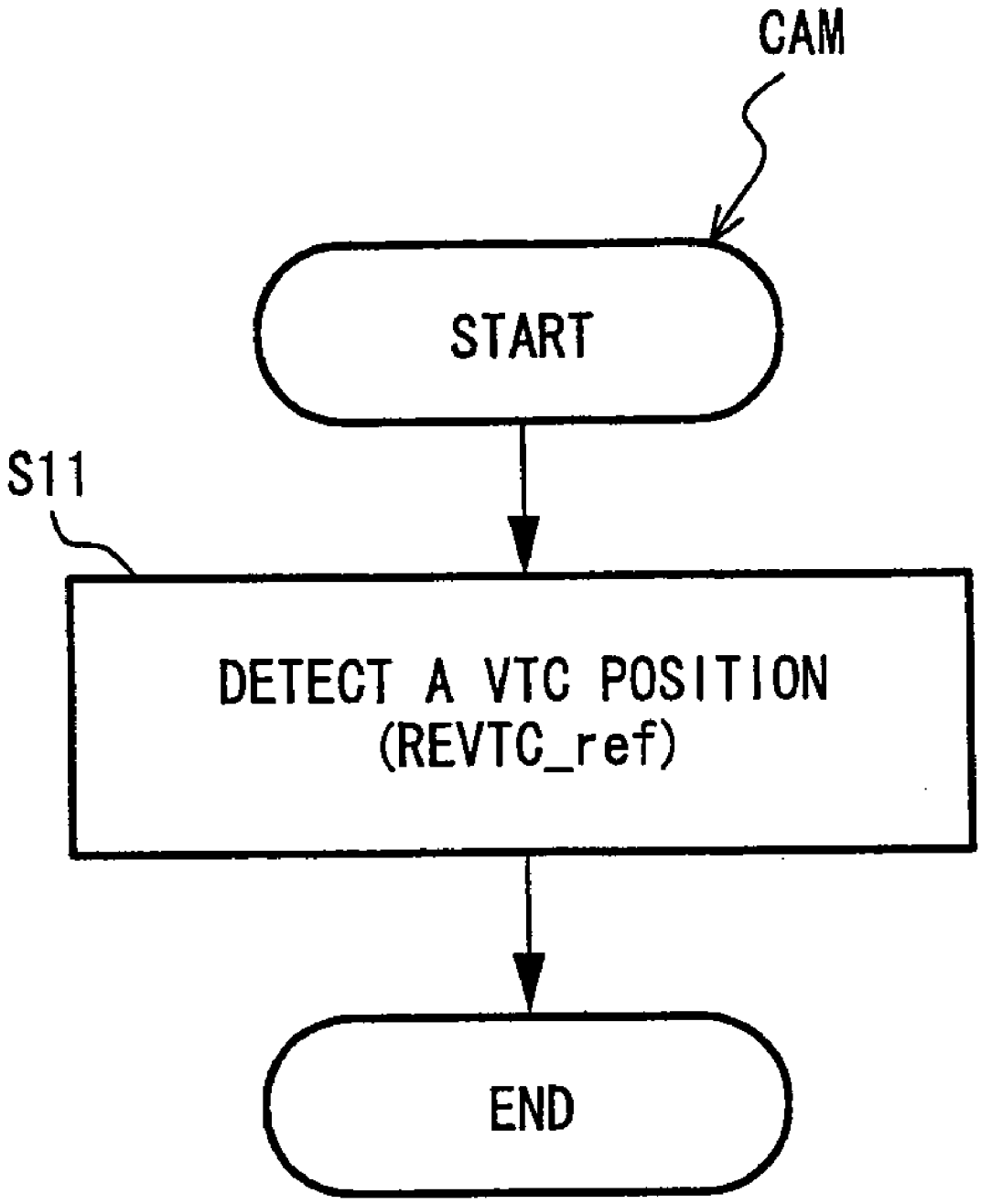
FIG. 24 is a flowchart showing processing for detecting a rotational phase each constant crank angle based on detection of reference rotational positions of a crankshaft and a camshaft.

To describe concretely, a counter is made to count up each generation of a unit angle signal POS, and on the other hand, the counter is made to be reset to 0 at the reference rotational position of crankshaft 120, and at step S11 in the flowchart of FIG. 24 in which an interruption is executed every time when a cam signal CAM (a head signal at each crank angle of 180°) is outputted, a rotational phase is detected by judging a value in the counter at that point in time.

Accordingly, a detected value of the rotational phase based on the reference rotational position is updated every time when a cam signal CAM is outputted from first cam sensor 132 (each crank angle of 180°), and at step S32, a value which has been updated at a time when a latest cam signal CAM is generated is read.

At step S33, a latest advance value REVTCnow computed on the basis of a detection signal from Hall element 545 is read.

Because a advance value REVTCref of the rotational phase which is read at step S32 is updated each constant crank angle, in a case in which an updating period is made long because of low engine rotational speed, time passes during a time from a latest updated timing to a timing of executing the main routine, and when the rotational phase is varied, an error is brought about with respect to an actual rotational phase.

Figure 25:
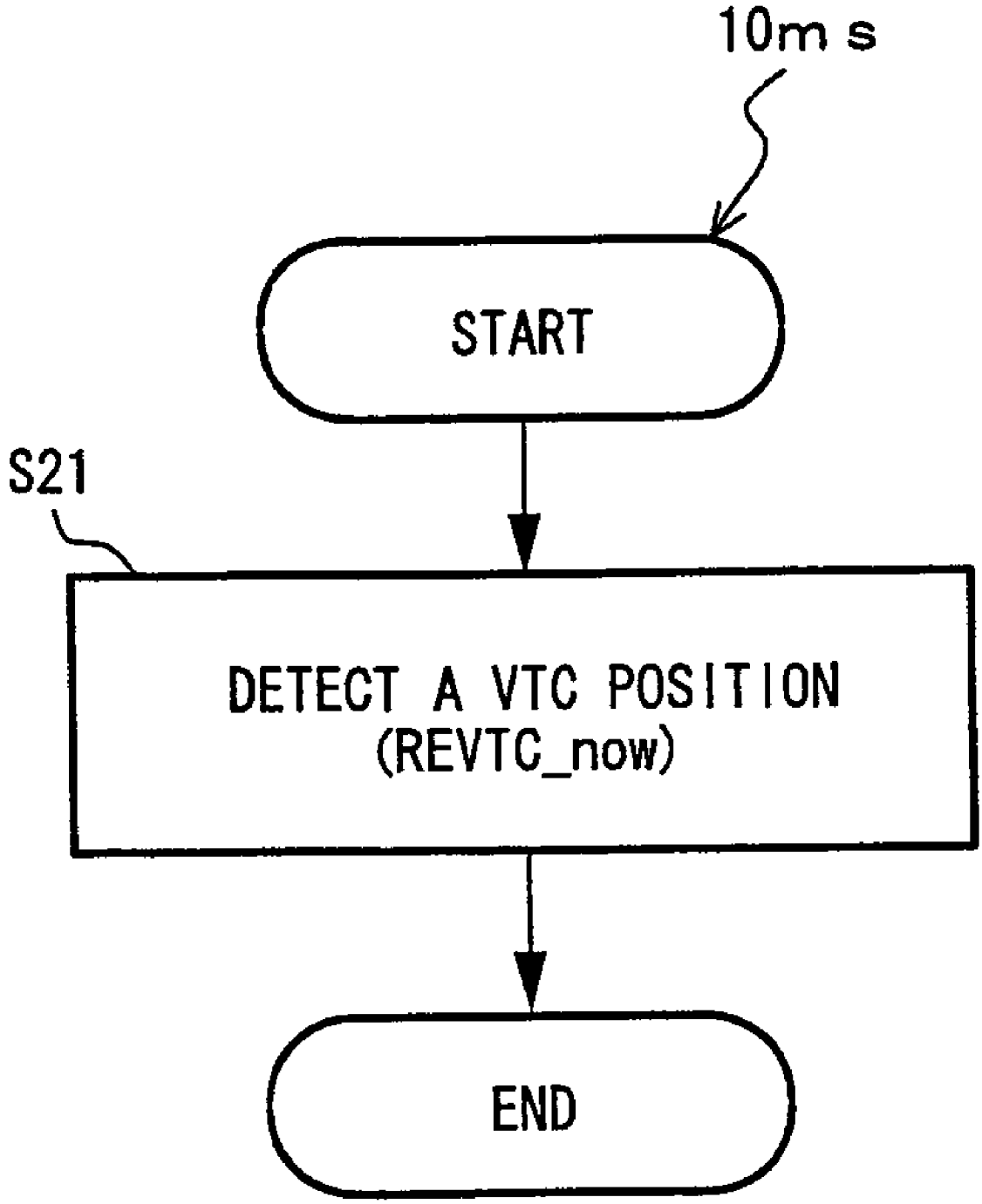
FIG. 25 is a flowchart showing processing for detecting a rotational phase each predetermined microtime.

On the other hand, because the advance value REVTCnow read at step S33 is computed each predetermined microtime at step S21 of FIG. 25 due to a detection signal from Hall element 545 being analog-to-digital converted each predetermined microtime (for example, 10 ms) and being read.

Accordingly, the advance value REVTCnow is a detected data without being influenced by an engine rotational speed, and without bringing about a large delay in detection with respect to an actual rotational phase.

At step S34, it is judged whether or not this moment in time is a timing of outputting a cam signal CAM, and is a timing of updating the advance value REVTCref.

When it is the timing of updating the advance value REVTCref, because the advance value REVTCref read at step S32 this time is a most up-to-date value of the centric phase at this point in time, the routine proceeds to step S36, and the advance value REVTCref is set to a detection value REVTC used for controlling the feedback control of the VTC mechanism 113.

On the other hand, at step S34, when it is judged that the moment in time is not a timing of outputting a cam signal CAM, the routine proceeds to step S35.

At step S35, it is judged whether or not an update of the advance value REVTCnow has been carried out from the timing of outputting a cam signal CAM at the last time (the timing of updating the advance value REVTCref) up to the point in time.

When an update of the advance value REVTCnow has not been carried out, the advance value REVTCref updated in the timing of outputting the cam signal CAM at the last time, i.e., the advance value REVTCref read at step S32 this time is a most up-to-date value up to now.

Then, the routine proceeds to step S36, the advance value REVTCref read at step S32 is set to a detection value REVTC used for controlling the feedback control of VTC mechanism 113.

Further, when an update of the advance value REVTCnow has been carried out from the timing of outputting a cam signal CAM at the last time (the timing of updating the advance value REVTCref) up to the point in time, the advance value REVTCnow read at step S33 is a most up-to-date detection value as a centric value.

Then, the routine proceeds to step S37, the advance value REVTCnow read at step S33 is set to a detection value REVTC used for controlling the feedback control of VTC mechanism 113.

Accordingly, when an update of the advance value REVTCnow is carried out after the timing of updating of the advance value REVTCref, thereafter, until it is made in a timing of updating the advance value REVTCref again, a most up-to-date value of the advance value REVTCnow is set to a detection value REVTC.

At step S38, a feedback-controlled amount of TC mechanism 113 (an exciting current value of electromagnetic coil 524) is computed on the basis of a deviation between the detection value REVTC and a target advance value TGVTC at that point in time.

At step S39, a duty signal for controlling the exciting current is outputted in accordance with the feedback-controlled amount.

When an engine rotational speed is low, and a period of updating the REVrCref is made longer, an update of the advance value REVTCnow is repeated during that time.

At that time, VTC mechanism 113 is controlled on the basis of the advance value REVTCnow in place of the advance value REVTCref.

Accordingly, VTC mechanism 113 is controlled on the basis of the advance value REVTCref in which there is the possibility that an error is brought about with an actual value because time has passed from the time of the updating, which can avoid overshooting the target advance value TGVTC.

By the way, when an engine rotational speed is made high, and a period of updating the advance value REVTCref is made less than or equal to a period of updating the advance value REVTCnow, there is no need to select the advance value REVTCnow in order to correspond to a delay in updating the advance value REVTCref.

Further, as compared with the advance value REVTCnow, the advance value REVTCref detected on the basis of a pulse signal has less error.

Figure 26:
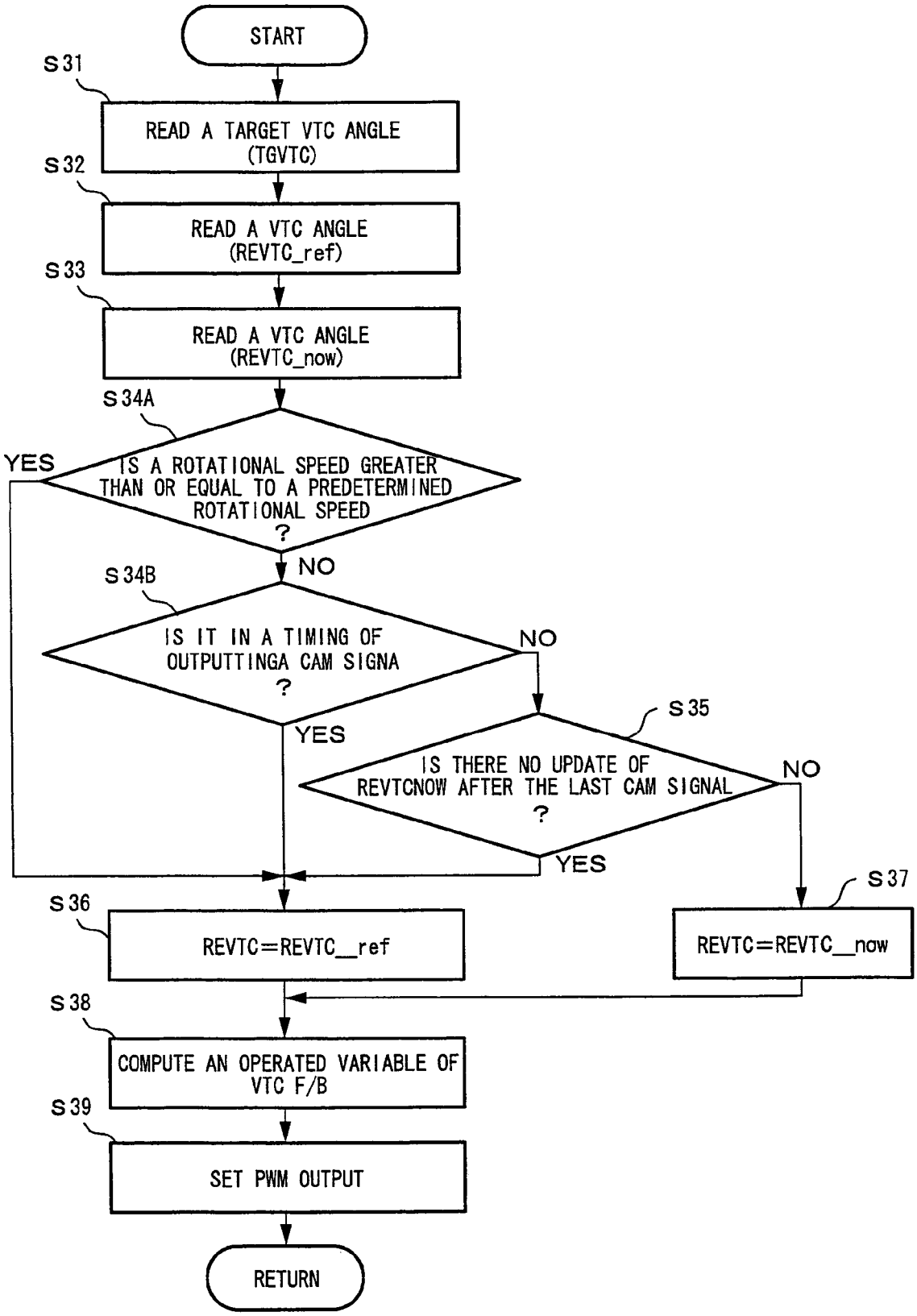
FIG. 26 is a flowchart showing a second embodiment of feedback control of the Variable valve Timing Control mechanism.

Then, as shown in the flowchart of FIG. 26, it can be structured such that it is switched whether or not the advance value REVTCnow is selected on condition of an engine rotational speed.

In the flowchart of FIG. 26, at step S34A, it is judged whether or not an engine rotational speed is greater than or equal to a predetermined rotational speed, in other words, a period of updating the advance value REVTCref is less than or equal to a period of updating the advance value REVTCnow.

Then, when an engine rotational speed is greater than or equal to the predetermined rotational speed, and a period of updating the advance value REVTCref is less than or equal to a period of updating the advance value REVTCnow, the routine jumps to step S36.

At step S36, due to the advance value REVTCref being set to the detection signal REVTC, VTC mechanism 113 is always made to be feedback-controlled on the basis of the advance value REVTCref.

On the other hand, when an engine rotational speed is less than the predetermined rotational speed, the routine proceeds to step S34B on and after, and the detection value REVTC is set in the same way as steps S34 to S37 in the flowchart of FIG. 23.

Figure 27:
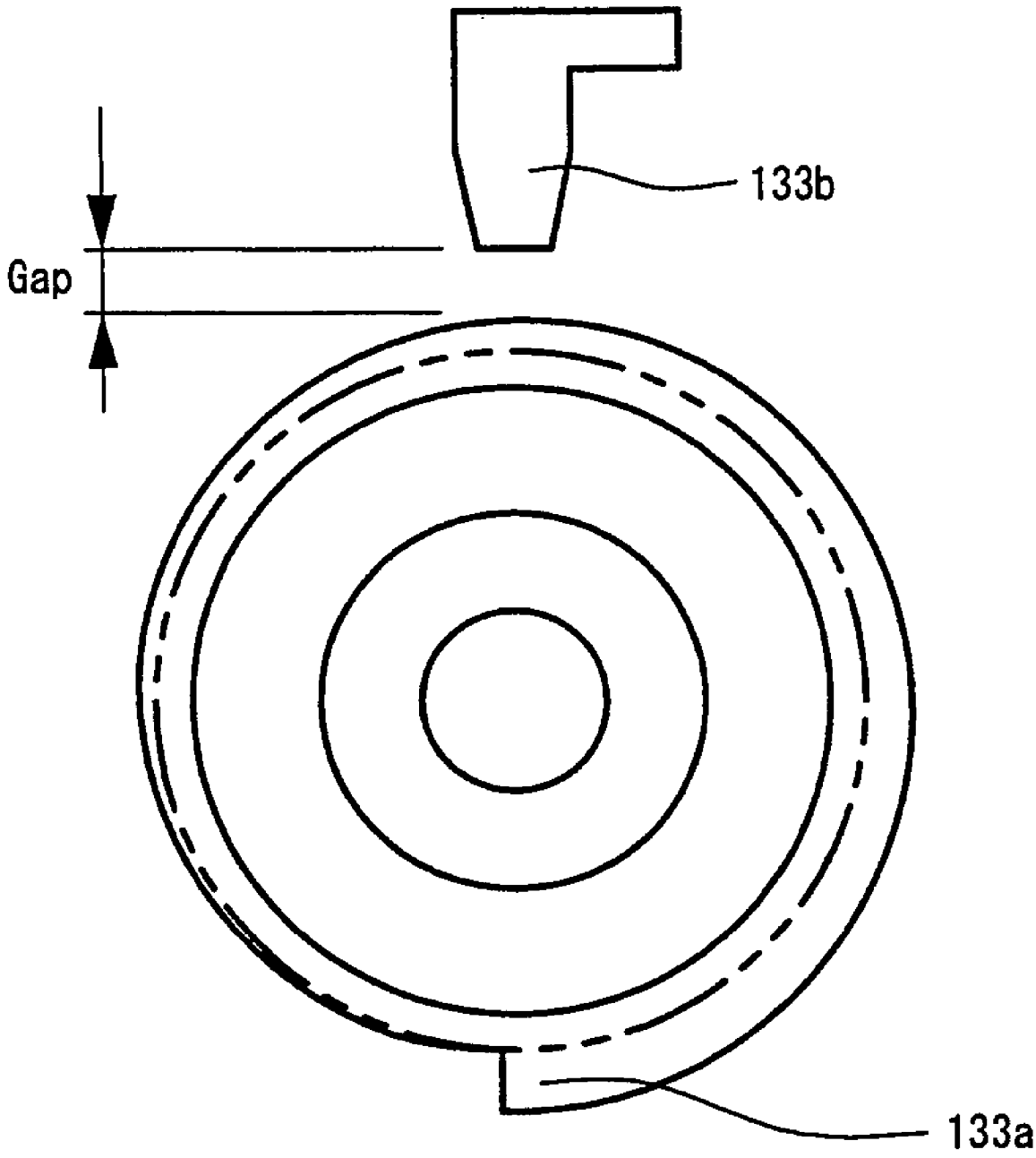
FIG. 27 is a diagram showing a structure of a second cam sensor.

By the way, due to a second cam sensor 133 shown in FIG. 27 being provided in place of Hall element 545, and by combining second cam sensor 133 and crank angle sensor 117, the centric phase of intake valve 105 can be detected in an arbitrary timing.

As shown in FIG. 27, second cam sensor 133 is formed from a rotator 133*a* and a gap sensor 133*b* fixed so as to face onto the peripheral edge of rotator 133*a*.

Rotator 133*a* is formed such that the radius is sequentially varied in the circumference direction, and is made to rotate so as to be integrated with camshaft 13.

Figure 28:
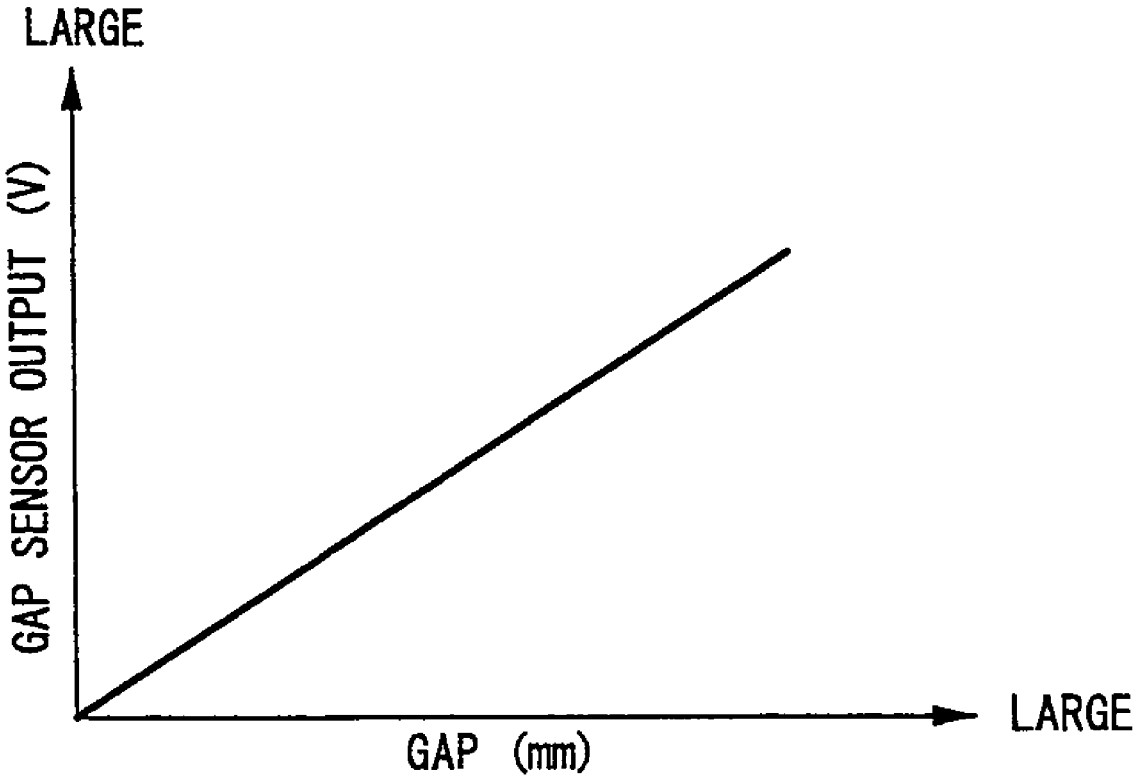
FIG. 28 is a graph showing a correlation between a gap and an output of a gap sensor.

Further the output from gap sensor 133*b* is, as shown in FIG. 28, sequentially varied due to a distance between gap sensor 133*b* and the peripheral edge of rotator 133*a* being varied by the rotations of the camshaft.

Here, the relationship between the angle position of the camshaft and the gap is constant.

Figure 29:
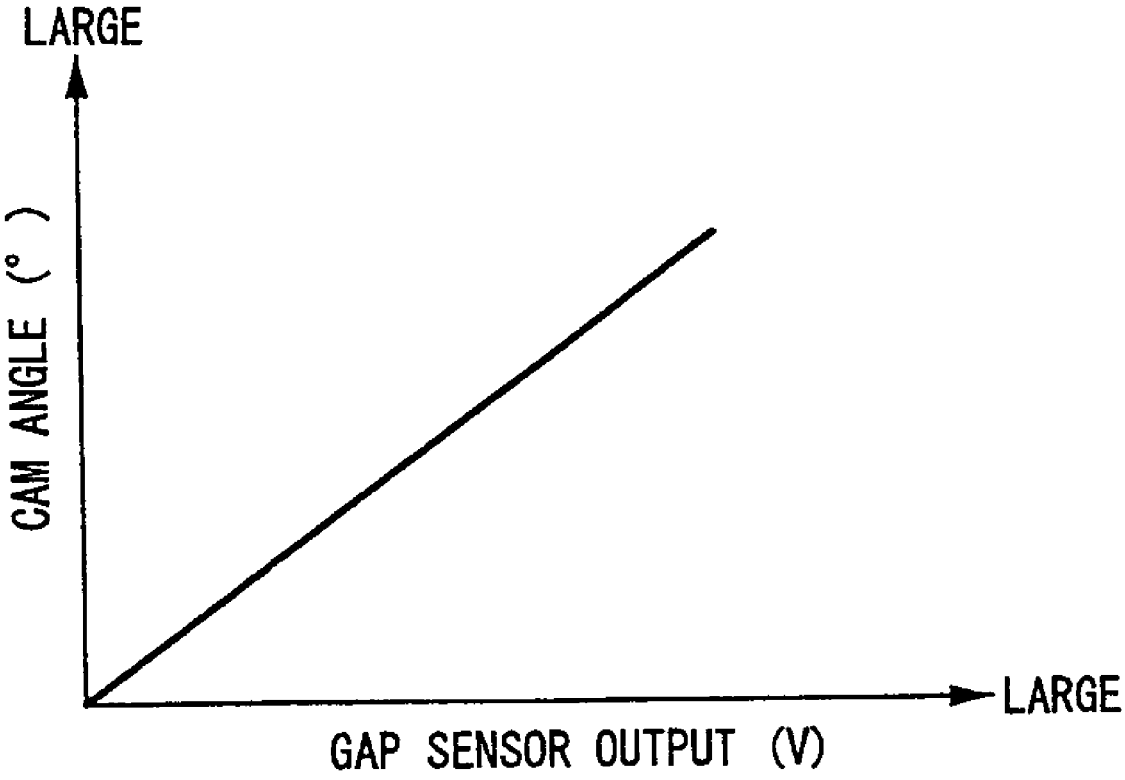
FIG. 29 is a graph showing a correlation between an angle position of the camshaft and an output of the gap sensor.

Accordingly, as shown in FIG. 29, the output of gap sensor 133*b* and the angle position of the camshaft have a constant correlation, and the angle position of the camshaft can be detected on the basis of the output of gap sensor 133*b*.

Here, suppose that the output of gap sensor 133*b* is a cam angle signal CAMA.

The angle position of crankshaft 120 is detected by counting the number of generations of the unit angle signals POS from a reference rotational position of crankshaft 120 detected by detecting a position at which the unit angle signal POS from crank angle sensor 117 is omitted. Further, the angle position of camshaft 13 is detected on the basis of the cam angle signal CAMA from second cam sensor 133.

Provided that the number of generating the unit angle signals POS from the reference rotational position of crankshaft 120 is made to be always counted, an angle of crankshaft 120 can be determined in an arbitrary timing with a minimum unit being as 10°. On the other hand, an angle of camshaft 13 can be determined in an arbitrary timing by reading a cam angle signal CAMA from second cam sensor 133 (an output from gap sensor 133*b*).

Then, at step S21 in the flowchart of FIG. 25 in which an interruption is executed each predetermined microtime (for example, 10 ms), a advance value REVTCnow of the rotational phase of camshaft 13 with respect to crankshaft 120 is computed on the basis of an angle position of crankshaft 120 and an angle position of camshaft 13 at that point in time.

Then, at the above-described step S33, a most up-to-date value of the advance value REVTCnow which has been determined on the basis of the angle position of crankshaft 120 and the angle position of camshaft 13 is read.

The advance value REVTCnow determined on the basis of the angle position of crankshaft 120 and the angle position of camshaft 13, which is read at step S33, is a most up-to-date value of the value which is updated each microtime, and is not greatly delayed in the detection as compared with the advance value REVTCref. Accordingly, the advance value REVTCnow detected by the gap sensor 133*b* has necessary and sufficient detecting responsiveness in place of the advance value REVTCnow detected by Hall element 545.

Note that, due to a sensor which detects an angle position by a gap sensor being provided at crankshaft 120 side as well, a centric phase can be detected in an arbitrary timing on the basis of detected results of gap sensor at crankshaft 120 side and gap sensor 133*b*.

In the present embodiment, it is structured such that the detection value REVTC is used only for controlling the feedback control of VTC mechanism 113. However, in addition thereto, it can be structured such that the detection value REVTC is used for, for example, controlling VEL mechanism 112 (for example, a control of limiting a maximum lift amount, and the like).

Further, a mechanism which makes a rotational phase of camshaft 13 with respect to crankshaft 120 variable, and a mechanism which makes an operating angle/a lift variable are not limited to VTC mechanism 13 and VEL mechanism 112 described above, and well-known mechanisms can be appropriately used.

Moreover, an engine valve to which VTC mechanism 113 is provided is not limited to intake valve 105, VTC mechanism 113 may be provided at exhaust valve 107 side, and the feedback control may be carried out in the same way in the above described embodiment.

Further, the advance value REVTCnow may be calibrated on the basis of the advance value REVTCref.

The entire contents of Japanese Patent Application NO.2004-051628, filed Feb. 26, 2004 and Japanese Patent Application NO. 2005-000337, filed Jan. 5, 2005 are incorporated herein by reference.

While only selected embodiments have been chosen to illustrate the present invention, it will be apparent to those skilled in the art from this disclosure that various change and modification can be made herein without departing from the scope of the invention as defined in the appended claims. Furthermore, the foregoing description of the embodiments according to the present invention are provided for illustration only, and not for the purpose of limiting the invention as defined by the appended claims and their equivalents.

We claim:

1. A variable valve operating control apparatus for an internal combustion engine comprising:

a Variable valve Timing Control mechanism which makes a centric phase of an operating angle of an engine valve variable due to a rotational phase of a camshaft with respect to a crankshaft being varied;

a first detecting unit which detects the centric phase of the operating angle of said engine valve each predetermined crank angle;

a second detecting unit which detects the centric phase of the operating angle of said engine valve each predetermined time; and a control unit which feedback-controls said Variable valve Timing Control mechanism on the basis of the centric phase detected at said first detecting unit when a detected result by said first detecting unit is updated, and which feedback-controls said Variable valve Timing Control mechanism on the basis of the centric phase detected by said second detecting unit during the interval of updating the detected result by said first detecting unit.

2. A variable valve operating control apparatus for an internal combustion engine according to claim 1, wherein said control unit feedback-controls said Variable valve Timing Control mechanism on the basis of a value which has been updated more recently between the detected result by said first detecting unit and the detected result by said second detecting unit.

3. A variable valve operating control apparatus for an internal combustion engine according to claim 1, wherein said control unit feedback-controls said Variable valve Timing Control mechanism on the basis of the detected result by said second detecting unit only when a period of updating the centric phase by said first detecting unit is greater than or equal to a predetermined value.

4. A variable valve operating control apparatus for an internal combustion engine according to claim 3, wherein said control unit judges whether or not the period of updating the centric phase by said first detecting unit is greater than or equal to the predetermined value on the basis of an engine rotational speed.

5. A variable valve operating control apparatus for an internal combustion engine according to claim 1, wherein said first detecting unit detects the centric phase of the operating angle of said engine valve on the basis of an interval between a reference rotational position of said crankshaft and a reference rotational position of said camshaft.

6. A variable valve operating control apparatus for an internal combustion engine according to claim 1, wherein said first detecting unit comprises a first sensor outputting a detection signal at the reference rotational position of said crankshaft, a second sensor outputting a detection signal at each unit crank angle, a third sensor outputting a detection signal at the reference rotational position of said camshaft, and a counter counting detection signals from said second sensor during a time from a time when the detection signal of said first sensor is generated up to a time when the detection signal of said third sensor is generated.

7. A variable valve operating control apparatus for an internal combustion engine according to claim 1, wherein said second detecting unit comprises a sensor whose output sequentially varies in accordance with a variation in the centric phase of the operating angle of said engine valve.

8. A variable valve operating control apparatus for an internal combustion engine according to claim 1, wherein said second detecting unit is structured such that a permanent magnet is provided at one side of a member which is relatively rotated in accordance with an operating state of said Variable valve Timing Control mechanism, and a yoke is provided at the other side thereof, and a clearance between a center of a magnetic pole of said permanent magnet and said yoke is varied by the relative rotation, and detects a variation in a magnetic flux density due to a variation in the clearance.

9. A variable valve operating control apparatus for an internal combustion engine according to claim 8, wherein said second detecting unit detects a variation in the magnetic flux density by a Hall element.

10. A variable valve operating control apparatus for an internal combustion engine according to claim 1, wherein said second detecting unit comprises a rotator which rotates so as to be integrated with said camshaft, and whose radius sequentially varies in a circumferential direction, a distance sensor which is fixed so as to face onto a peripheral edge of said rotator, and which outputs a detection signal corresponding to a variation in a relative distance with the peripheral edge of said rotator, a crank angle sensor which detects a rotational angle of said crankshaft each micro-rotational angle, and a computing unit which computes the centric phase of the operating angle of said engine valve on the basis of a rotational angle of said camshaft detected on the basis of an output of said distance sensor and a rotational angle of said crankshaft detected at said crank angle sensor.

11. A variable valve operating control apparatus for an internal combustion engine according to claim 1, wherein said second detecting unit comprises a first rotator which rotates so as to be integrated with said camshaft, and whose radius sequentially varies in a circumferential direction, a first distance sensor which is fixed so as to face onto a peripheral edge of said first rotator, and which outputs a detection signal corresponding to a variation in a relative distance with the peripheral edge of said first rotator, a second rotator which rotates so as to be integrated with said crankshaft, and whose radius sequentially varies in a circumferential direction, a second distance sensor which is fixed so as to face onto a peripheral edge of said second rotator, and which outputs a detection signal corresponding to a variation in a relative distance with the peripheral edge of said second rotator, and a computing unit which computes the centric phase of the operating angle of said engine valve on the basis of a rotational angle of said camshaft detected on the basis of an output of said first distance sensor and a rotational angle of said crankshaft detected on the basis of an output of said second distance sensor.

12. A variable valve operating control apparatus for an internal combustion engine according to claim 1, wherein said Variable valve Timing Control mechanism comprises:

a driving member to which a turning force is transmitted from said crankshaft;

a driven member which is provided so as to be integrated with said camshaft;

an intermediate rotator which is provided between said driving member and said driven member, and which accelerates and decelerates a rotation transmitted to said driven member by being relatively rotated with respect to said driving member; and an electromagnetic actuator which makes said intermediate rotator relatively rotate with respect to said driving member.

13. A variable valve operating control apparatus for an internal combustion engine comprising:

a Variable valve Timing Control mechanism which makes a centric phase of an operating angle of an engine valve variable due to a rotational phase of a camshaft with respect to a crankshaft being varied;

first detecting means for detecting the centric phase of the operating angle of said engine valve each predetermined crank angle;

second detecting means for detecting the centric phase of the operating angle of said engine valve each predetermined time; and control means for feedback-controlling said Variable valve Timing Control mechanism on the basis of the centric phase detected by said first detecting means when a detected result by said first detecting means is updated, and for feedback-controlling said Variable valve Timing Control mechanism on the basis of the centric phase detected by said second detecting means during the interval of updating a detected result by said first detecting means.

14. A method for controlling an internal combustion engine which has a Variable valve Timing Control mechanism which makes a centric phase of an operating angle of an engine valve variable due to a rotational phase of a camshaft with respect to a crankshaft being varied, comprising the steps of:

detecting the centric phase of the operating angle of said engine valve each predetermined crank angle;

detecting the centric phase of the operating angle of said engine valve each predetermined time;

feedback-controlling said Variable valve Timing Control mechanism on the basis of the centric phase detected said each predetermined crank angle in a timing of updating at said each predetermined crank angle; and feedback-controlling said Variable valve Timing Control mechanism on the basis of the centric phase detected said each predetermined time during the interval of update-timing at said each predetermined crank angle.

15. A method for controlling an internal combustion engine according to claim 14 further comprising a step of:

judging a timing of latest updating between the timing of updating at each predetermined crank angle and the timing of updating at each predetermined time, wherein the step of feedback-controlling said Variable valve Timing Control mechanism on the basis of the centric phase detected said each predetermined crank angle feedback-controls said Variable valve Timing Control mechanism on the basis of the centric phase detected said each predetermined crank angle when the timing of latest updating is a timing of updating at said each crank angle; and the step of feedback-controlling said Variable valve Timing Control mechanism on the basis of the centric phase detected said each predetermined time feedback-controls said Variable valve Timing Control mechanism on the basis of the centric phase detected said each predetermined time when the timing of latest updating is a timing of updating at said each predetermined time.

16. A method for controlling an internal combustion engine according to claim 14 further comprising the steps of judging whether or not an updating period at said each predetermined crank angle is greater than or equal to a predetermined time, and permitting feedback-control of said Variable valve Timing Control mechanism based on the centric phase detected said each predetermined time only when the updating period is greater than or equal to a predetermined time.

17. A method for controlling an internal combustion engine according to claim 16, wherein the step of judging whether or not an updating period at said each predetermined crank angle is greater than or equal to a predetermined time comprises the steps of detecting an engine rotational speed, and judging whether or not the engine rotational speed is greater than or equal to a predetermined rotational speed.

18. A method for controlling an internal combustion engine according to claim 14, wherein the step of detecting the centric phase of the operating angle of said engine valve each predetermined crank angle comprises the steps of detecting a reference rotational position of said crankshaft, detecting a reference rotational position of said camshaft, and measuring a crank angle from the reference rotational position of said crankshaft up to the reference rotational position of said camshaft.

19. A method for controlling an internal combustion engine according to claim 14, wherein the step of detecting the centric phase of the operating angle of said engine valve each predetermined time comprises the steps of generating a detection signal which sequentially varies in accordance with a variation in the centric phase, and computing the centric phase said each predetermined time on the basis of the detection signal.

20. A method for controlling an internal combustion engine according to claim 14, wherein the step of generating a detection signal which sequentially varies in accordance with a variation in the centric phase comprises the steps of providing a permanent magnetic at one side of a member which relatively rotates in accordance with an operating state of said Variable valve Timing Control mechanism, and providing a yoke at the other side thereof, and generating a detection signal denoting a variation in a magnetic flux density due to a variation in a clearance between a center of a magnetic pole of said permanent magnetic and said yoke.

* * * * *